US012127721B1

(12) United States Patent
Park et al.

(10) Patent No.: US 12,127,721 B1
(45) Date of Patent: Oct. 29, 2024

(54) MOUNTABLE REPLENISHABLE DISPENSING SYSTEM

(71) Applicant: Gilchrist & Soames, Inc., Somerset, NJ (US)

(72) Inventors: Joungsu Park, South Brunswick, NJ (US); Tracey Leacock, Plainfield, NJ (US); Matthew Schmitt, Skillman, NJ (US)

(73) Assignee: Gilchrist & Soames, Inc., Somerset, NJ (US)

( * ) Notice: Subject to any disclaimer, the term of this patent is extended or adjusted under 35 U.S.C. 154(b) by 0 days.

(21) Appl. No.: 18/609,911

(22) Filed: Mar. 19, 2024

Related U.S. Application Data

(60) Provisional application No. 63/604,393, filed on Nov. 30, 2023, provisional application No. 63/458,860, filed on Apr. 12, 2023.

(51) Int. Cl.
*A47K 5/12* (2006.01)

(52) U.S. Cl.
CPC ..... *A47K 5/1205* (2013.01); *A47K 2201/025* (2013.01)

(58) Field of Classification Search
CPC ..... A47K 5/1205; F16M 13/02
USPC ..... 141/2
See application file for complete search history.

(56) References Cited

U.S. PATENT DOCUMENTS 10,527,224 B1 * 1/2020 Park ..... F16M 13/02
2009/0026225 A1 * 1/2009 Lickstein ..... A47K 5/1202 222/325
2016/0288151 A1 * 10/2016 Schultz ..... A47K 5/1207
2022/0167802 A1 * 6/2022 Bing ..... A47K 5/1205
2023/0346171 A1 * 11/2023 Runius ..... A47K 5/1205

FOREIGN PATENT DOCUMENTS

DE 102017122729 A1 * 4/2019

OTHER PUBLICATIONS

Machine translation of DE-102017122729-A1.*
International Search Report and Written Opinion dated Jun. 4, 2024 in co-pending PCT Application No. PCT/US2024/020584.
(Continued)

*Primary Examiner* — Jeremy Carroll
(74) *Attorney, Agent, or Firm* — Perilla Knox & Hildebrandt LLP

(57) ABSTRACT

A personal-hygiene fluid is dispensed from a system including a wall-mountable support bracket, a replaceable dispenser assembly, and a cover shell. The dispenser assembly includes a container holding the fluid and a dispensing pump attached to the container, with the dispenser assembly removably positionable on the bracket. And the shell removably fits onto the bracket and over the container to obscure the container from view. In some embodiments, the dispenser assembly includes a collar attached between the container and the dispensing pump, and the bracket includes a recess that receives the collar to removably mount the dispenser assembly to the bracket. In some embodiments, the shell and the bracket include engaging slide surfaces the enable the shell to vertically slide on and off of the bracket. Also disclosed are a method of replacing the containers of the system, and replacement containers for use in the system and method.

20 Claims, 29 Drawing Sheets

(56) References Cited

OTHER PUBLICATIONS

Image of a dispenser, untitled, publication date unknown, accessed online Nov. 13, 2023.
Groupe GM—Ecofill 400ml, A new and innovative refillable and traceable eco-friendly dispenser, https://www.youtube.com/watch?v=9QNR8wAKDnA, accessed Nov. 16, 2024.

* cited by examiner

MOUNTABLE REPLENISHABLE DISPENSING SYSTEM

CROSS-REFERENCE TO RELATED APPLICATIONS

This application claims the priority benefit of U.S. Provisional Patent Application Ser. No. 63/604,393, filed Nov. 30, 2023, and U.S. Provisional Patent Application Ser. No. 63/458,860, filed Apr. 12, 2023, which are hereby incorporated herein by reference in their entireties.

TECHNICAL FIELD

The invention relates generally to dispensing systems for personal-hygiene fluids such as soaps, sanitizers, and shampoos, and more particularly, to such dispensing systems that are fixedly mounted in place and replenishable with the personal-hygiene fluids.

BACKGROUND

The hospitality industry is a broad category within the service industry that includes hotels and lodging, food and drink establishments, special events, theme parks, transportation vehicles, cruise lines, and travel and tourism in general. In such hospitality locations, it's common to have refillable containers with personal-hygiene fluids such as soaps, facial cleansers, sanitizers, lotions, shampoos, conditioners, and various other fluids for dispensing for consumer use. Such dispensers are typically in bath and restroom areas, and are typically wall-mounted and temporarily removable for refilling purposes.

An issue with existing wall-mounted, refillable dispensers is that they do not adequately meet the simultaneous desirable characteristics of being attractive, unobtrusive, easily maintained, and tamper-resistant. Commonly-owned U.S. Pat. No. 10,527,224, the entire content of which is incorporated herein by reference, provides an advance over previous wall-mounted, refillable dispensing systems. However, further improvements are desired.

SUMMARY

Generally described, the present invention relates to a dispensing system for a personal-hygiene fluid. The dispensing system includes a wall-mountable support bracket, a replaceable dispenser assembly, and a cover shell. The dispenser assembly includes a container holding the fluid and a dispensing pump attached to the container, with the dispenser assembly removably positionable on the support bracket. And the shell removably fits onto the support bracket and over the container to obscure the container from view. In some embodiments, the dispenser assembly includes a collar attached between the container and the dispensing pump, and the support bracket includes a recess that receives the collar to removably mount the dispenser assembly to the support bracket. In some embodiments, the shell and the support bracket include engaging slide surfaces the enable the shell to slide on and off of the support bracket. Additional aspects of the invention include a method of replacing the containers of the system, and replacement containers for use in the system and method.

The specific techniques and structures employed to improve over the drawbacks of the prior art and accomplish the advantages described herein will become apparent from the following detailed description of example embodiments and the appended drawings and claims.

DETAILED DESCRIPTION OF EXAMPLE EMBODIMENTS

Figure 1:
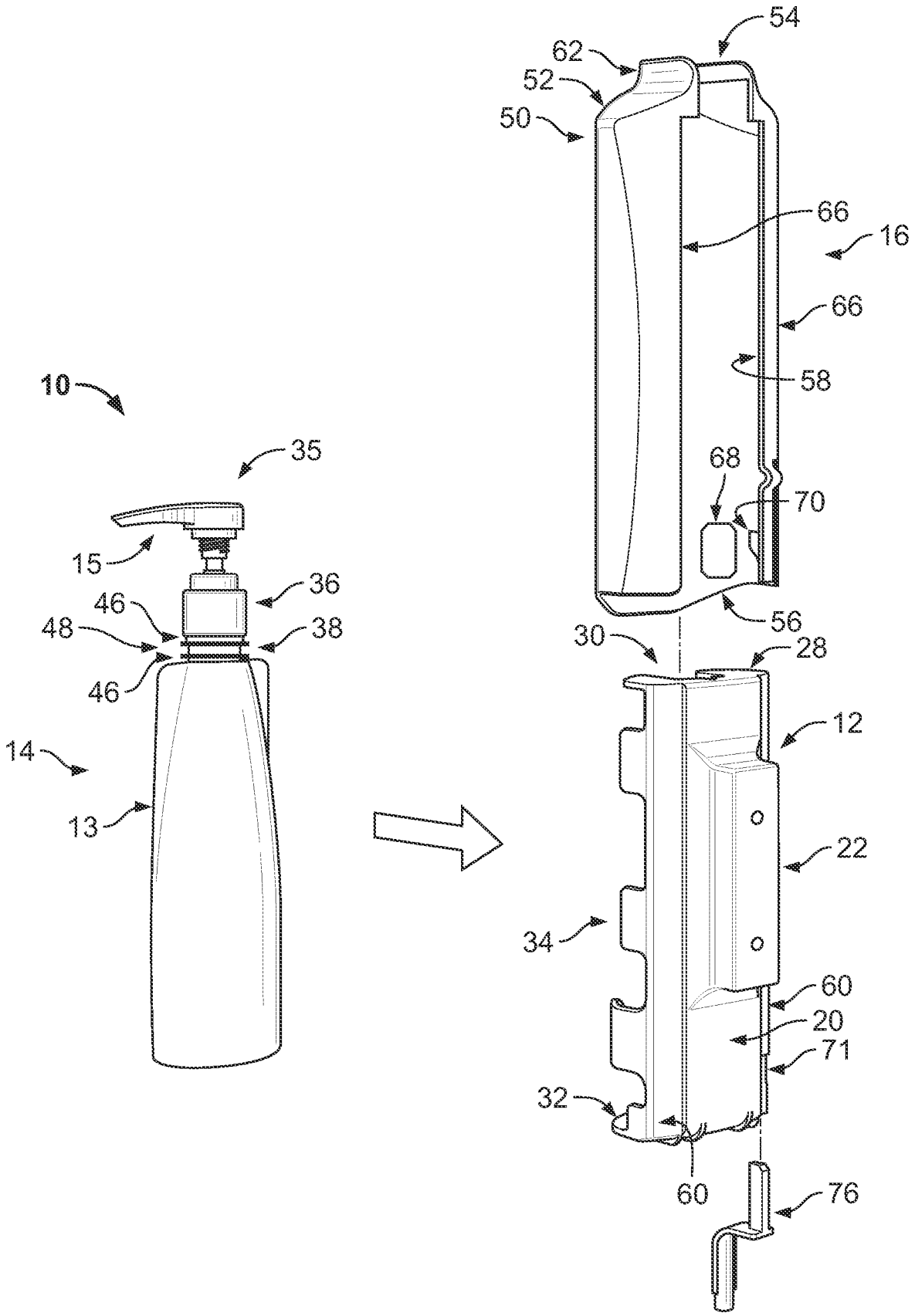
FIG. 1 is a perspective exploded view of a dispensing system according to a first example embodiment, showing a support bracket with a mounting bracket, a dispenser assembly including a container and a dispenser, and a cover shell in a disassembled state.

The present invention generally relates to dispensing systems that can be used to hold and dispense person-hygiene fluids, for example soaps, facial cleansers, sanitizers, antimicrobials, lotions, shampoos, conditioners, cosmetics, and other fluids for consumer use. The personal-hygiene fluids can be any type of flowable material with any usable viscosity, including gels and foams. The dispensing systems are fixedly mounted in place, for example in bathrooms to walls (including within shower stalls and tubs) or to vanity tops. For use in public places, the improved dispensing systems can include different options affording tamper-resistance.

The dispensing system includes a support bracket, a dispenser assembly, and a cover shell. These components can be made using materials, manufacturing equipment, and fabrication techniques that are conventional and well known, for example using any suitable durable material such as ABS, aluminum, post-consumer recycled (PCR) plastic, and/or other molded plastics, and for example flexible materials such as PET/PE when the container is a collapsible pouch.

The support bracket securely mounts to a wall, countertop, or other surface in order to fixedly mount the dispensing system in place. The surface mounting of the support bracket can be provided by various different options, including a lockable rail/receptacle structure that enables removal of the support bracket, or a more permanent arrangement that uses screws and/or double-sided tape. The lockable rail/receptacle structure can be tamper-resistant and key-released, as described in U.S. Pat. No. 10,527,224. U.S. Design Pat. Nos. D915,866 and D918,017, also incorporated herein by reference, disclose additional rail-and-bracket designs that can be used.

The dispenser assembly includes a delivery mechanism coupled to a container that contains the fluid to be dispensed. The delivery mechanism can be a manually operated pump (with a dip tube extending to the bottom interior of the container and a dispensing spout) or other delivery mechanism capable of dispensing the personal-hygiene fluid, with the delivery mechanism selected to provide dispensing functionality based on the viscosity of the particular personal-hygiene fluid to be dispensed. The container can be a flexible pouch, a rigid or semi-rigid bottle, or another vessel or receptacle capable of containing the personal-hygiene fluid. In example embodiments, the container is a collapsible pouch, that is, any flexible bag structure capable of containing any type of liquid, lotion, gel, foam, or other personal-hygiene fluid product and collapsing as the fluid is dispensed/emptied (the bag does not retain the same shape/volume in its full and empty states).

Typically, the delivery mechanism and the container are detachably coupled together by a coupling. In example embodiments, a collar has a lower portion permanently affixed to the container and an upper portion including a fitting (e.g., threaded) that forms one part of the coupling, with the delivery mechanism including the other part of the coupling (e.g., threaded) so that the delivery mechanism can be removably connected to the collar and thus the container. The coupling thus enables the delivery mechanism and the container to be coupled together during use and decoupled after use for replenishment (replacement or refilling) of the container. Typically, a cap is removably connected to the collar fitting during storage/transport of the container before and after use.

The dispenser assembly is removably positionable on and supportable by the support bracket. For example, the collar can additionally include a portion (e.g., a midsection between the lower and upper portions) that removably mounts to the support bracket (e.g., with a snap fit). This enables the container to be secured in place during use and removed from the support bracket to replenish (replace or refill) the container.

The cover shell removably mounts to the support bracket, and when mounted for use it cooperates with the support bracket to substantially enclose and conceal/obscure the container. In some embodiments, the support bracket can have a cage-like structural arrangement that cooperates with the shell to substantially conceal/obscure the container and the support bracket when mounted for use.

The shell and the support bracket typically slide relative to each other, so that the shell can slide onto the support bracket and over the dispenser assembly without disturbance or interference from the container. A key system can be provided to lock and release the shell and dispenser assembly to and from each other to provide tamper-resistant maintenance in public or hospitality environments. Also, the shell can include an aperture or clear (including transparent or translucent) portion near its bottom edge that can be used as a viewing window to enable visually observing when the fluid level is low and replenishment is needed. When a maintenance person sees that the product has been extinguished/depleted (and/or the collapsible pouch container has collapsed), the dispensing system can be disassembled to replenish (replace or refill) the container.

In this way, the shell mounts to the bracket and covers the pouch/container to conceal/obscure the pouch from view (except for the viewing window for monitoring the fluid level) while also covering the interface/coupling of the dispenser collar to the bracket recess to conceal/obscure the interface from view. But the shell does not mechanically interfere with the pouch/container or the interface. Accordingly, the pouch/container is concealed by the shell on the top, the front, and both sides, the wall on the back, and by the bracket bottom shelf (or alternatively a bottom wall of the shell) on the bottom.

To replenish the dispenser assembly with fresh personal-hygiene fluid product, the shell can be removed from the support bracket to expose/access the container, the dispenser assembly can be removed from the support bracket, the delivery mechanism can be removed from the container, and the container (with the attached collar) can be replenished, either replaced with a new/full container (with the depleted container disposed of or recycled) or refilled for reuse. All other components of the dispensing system can be reused.

The use of a disposable, collapsible pouch container can dramatically decrease the volume of waste generated, and all components, including the pouch container, can be made from biodegradable or recyclable materials. As a result, the dispensing system helps reduce the carbon footprint and offers sustainable solutions for waste reduction.

It should be noted that the terms "rear" and "rearward" as used herein refer to the side against the mounting wall/surface, and the terms "front" and "forward" refer to the side that is opposite (and thus typically facing the user of the dispensing system 10). Also, the terms "top" and "upper," and the terms "bottom" and "lower," are representative for the depicted embodiments in a typical installation orientation, and thus are not unnecessarily limiting of the intended scope of the invention (e.g., some embodiments of the dispensing system can be installed in inverted orientations with the "upper" parts being positioned below the "lower" parts).

Referring now to the drawings, FIGS. 1-28 show a dispensing system 10 according to a first example embodiment. The dispensing system 10 includes a support bracket 12, a dispenser assembly 14, and a cover shell 16. The support bracket 12 mounts to a wall or other surface to secure the dispensing system 10 in place, the dispenser assembly 14 includes a container 13 and a delivery mechanism 15 and removably mounts to the support bracket 12 to position the dispenser assembly 14 for dispensing use, and the cover shell 16 removably mounts to the support bracket 12 to obscure/conceal and secure the container 13 during dispensing use.

Figure 2:
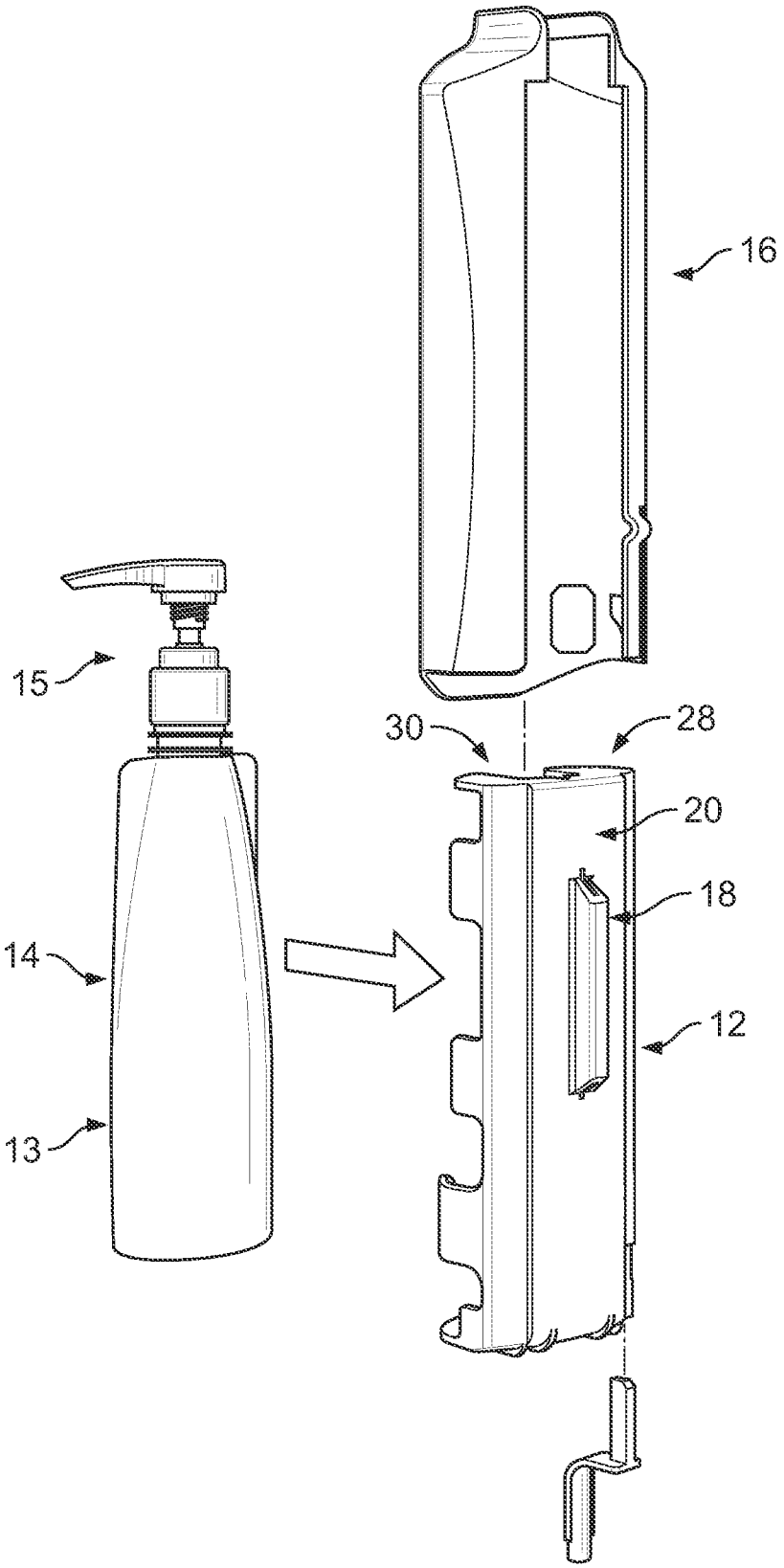
FIG. 2 shows the dispensing system of FIG. 1 with the mounting bracket removed from the support bracket.
Figure 3:
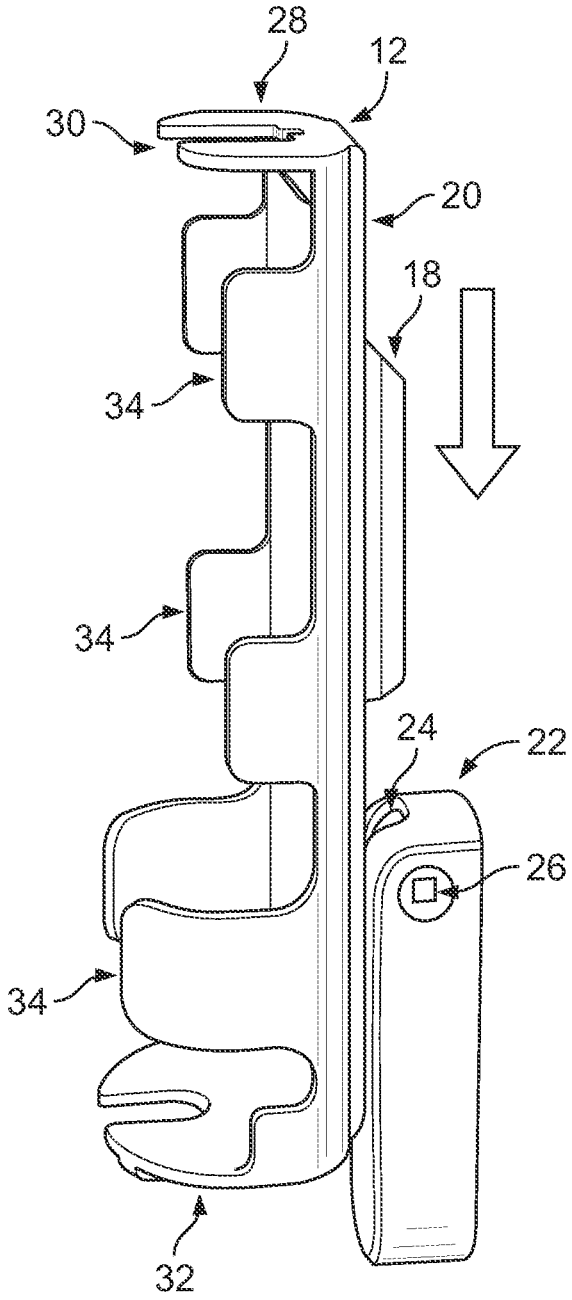
FIG. 3 is a perspective view of the support bracket of FIG. 1 being mounted onto the mounting bracket.
Figure 4:
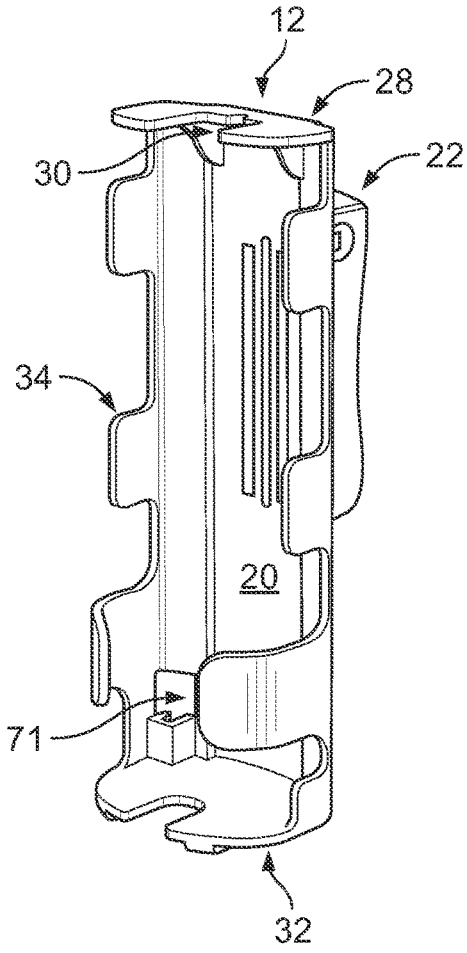
FIG. 4 is another perspective view of the support bracket of FIG. 1.
Figure 5:
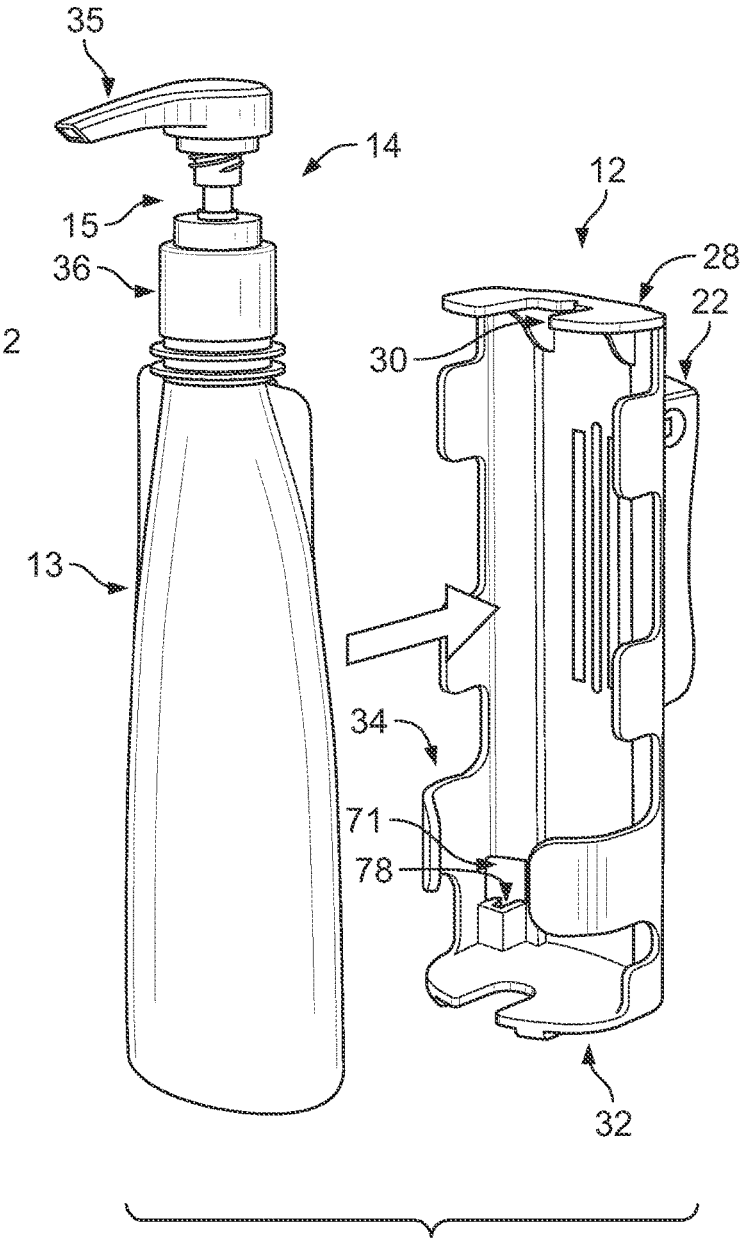
FIG. 5 is a perspective view of the dispenser assembly being mounted on the support bracket of FIG. 1.
Figure 6:
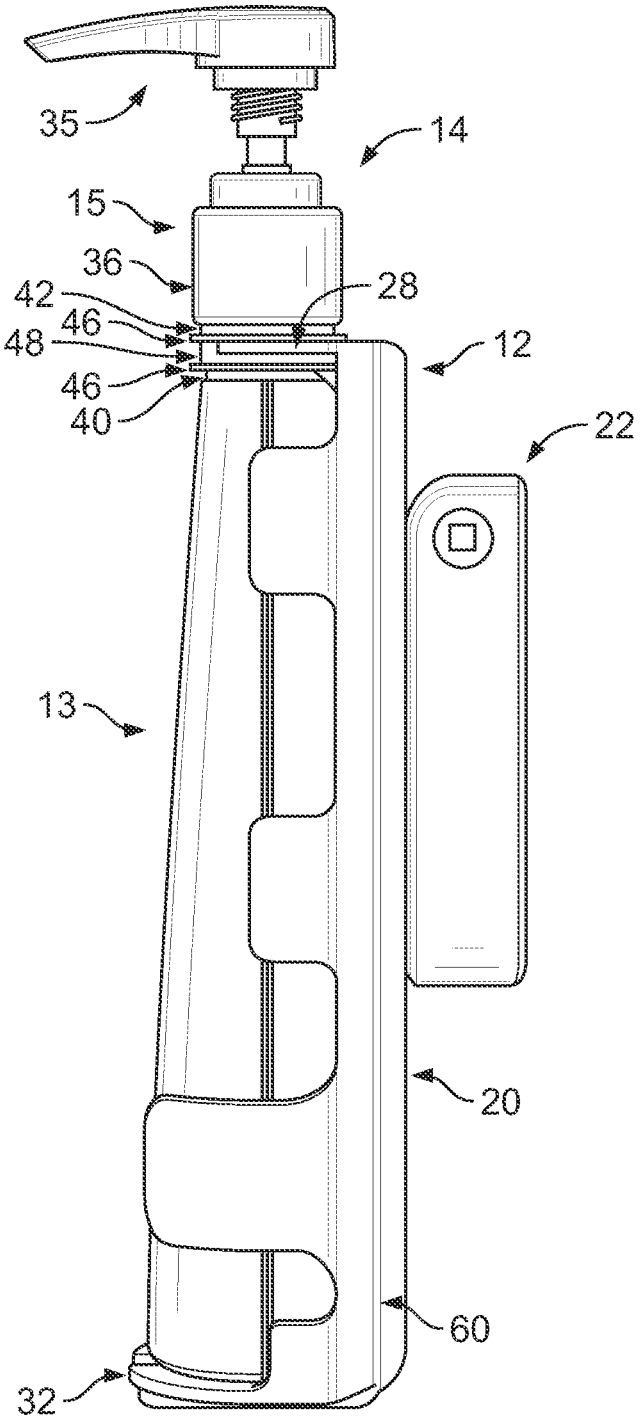
FIG. 6 is a side view of the dispenser assembly mounted to the support bracket of FIG. 1.
Figure 6A:
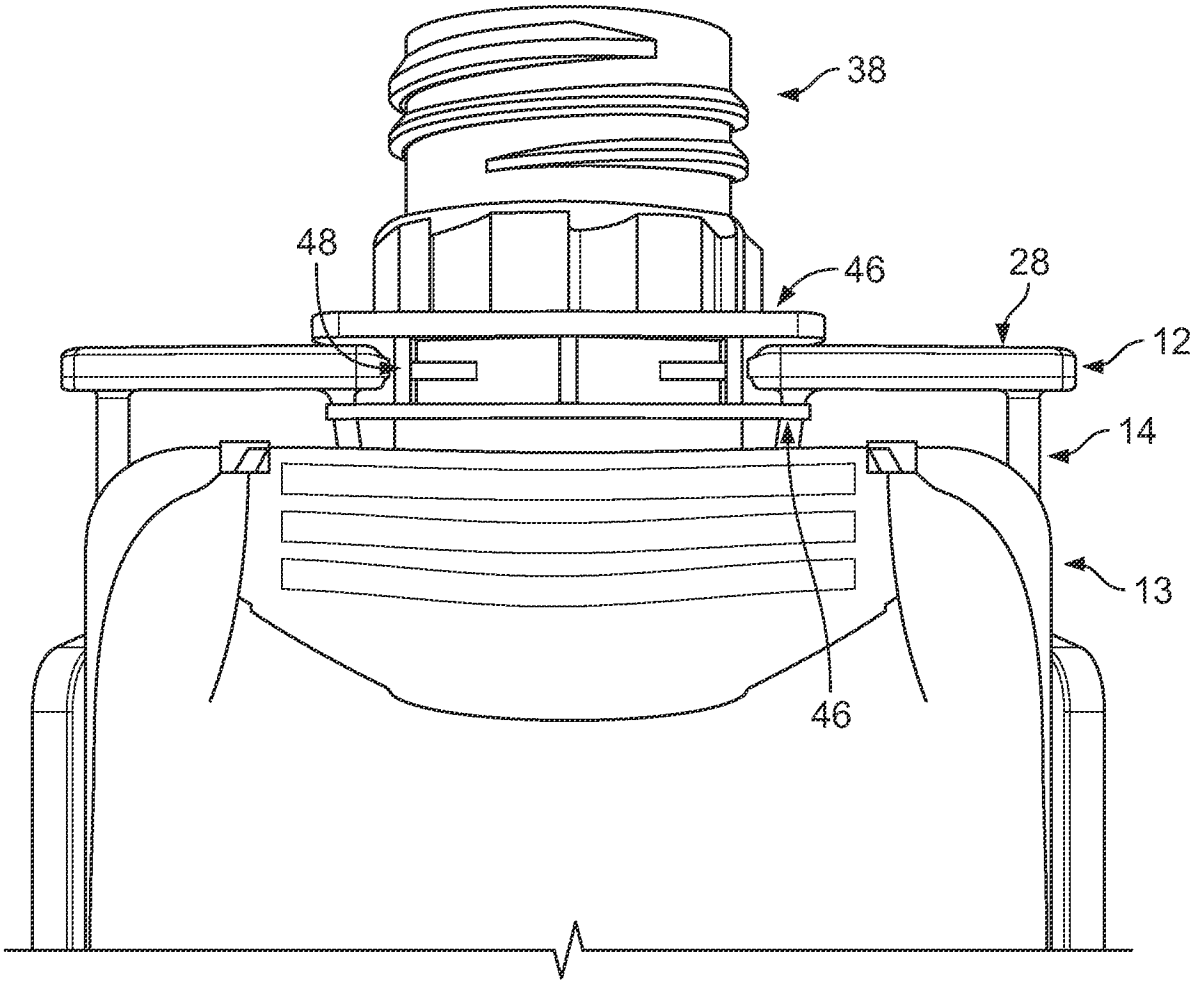
FIG. 6A is a front side detail view of a portion of the dispenser assembly and support bracket of FIG. 6.
Figure 7:
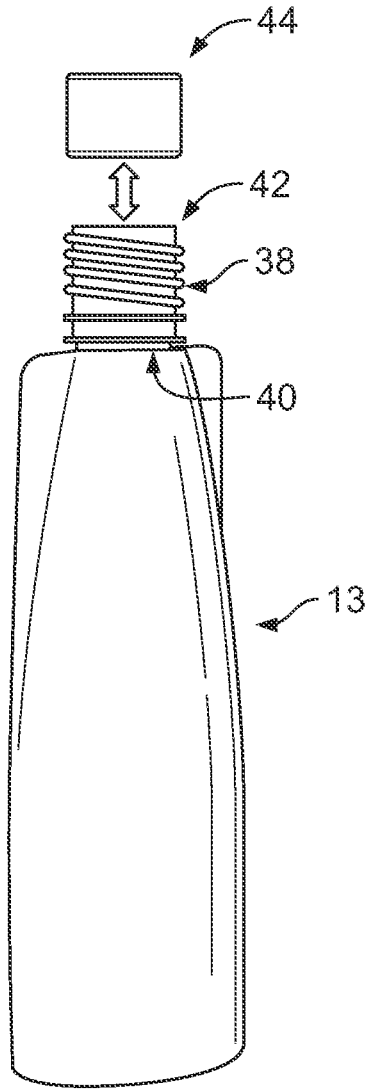
FIG. 7 is a front view of a replacement container for coupling to a delivery mechanism to form the dispenser assembly of FIG. 1.
Figure 8:
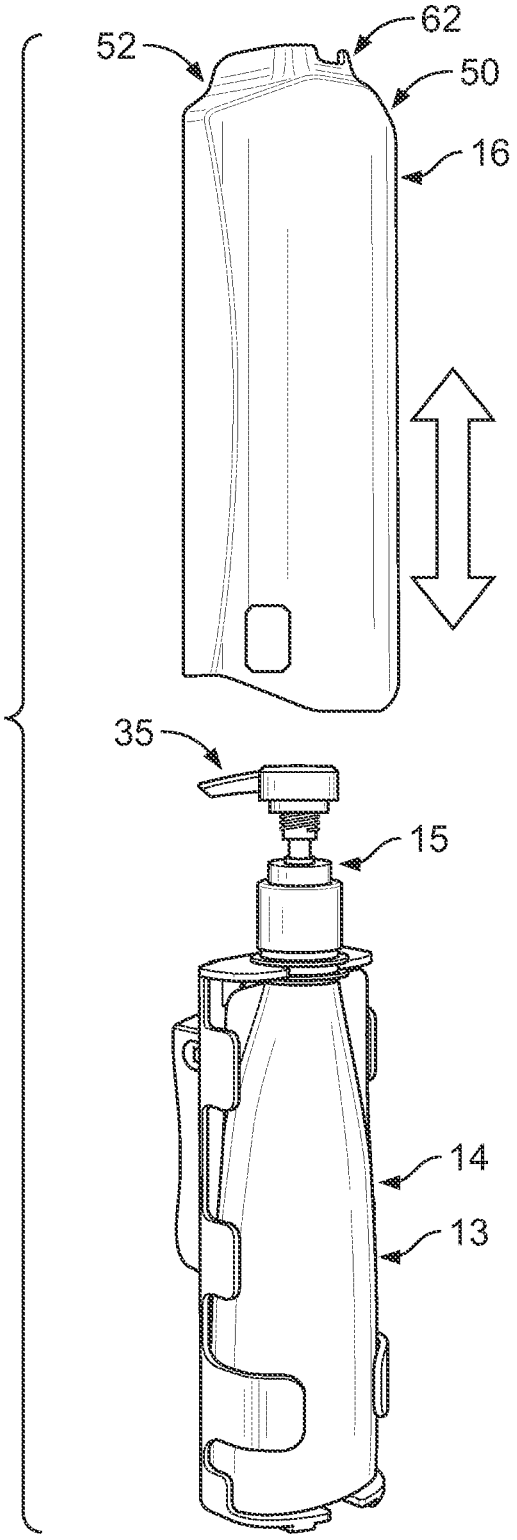
FIG. 8 is a perspective view of the dispensing system of FIG. 1, showing the dispenser assembly mounted to the support bracket, with the shell vertically aligned for vertically sliding relative to them.

Referring particularly to FIGS. 1-3, the dispensing system 10 includes a mounting system that functions to removably mount the support bracket 12 to a wall or other surface. The support bracket 12 can be mounted to the surface by a mounting system that is direct (e.g., screws, adhesives, or other fasteners) or indirect (e.g., a mounting bracket that mounts between the support bracket 12 and the mounting surface). In the depicted embodiment, the mounting system is an indirect rail-and-receptacle mounting system of the type described and shown in the utility and design patents referenced above. The depicted rail-and-receptacle mounting system includes a rail 18 extending rearward from a rear panel 20 of the support bracket 12 and a surface-mountable bracket 22 with a receptable 24 that slidingly receives and retains the rail 18. This two-part mounting system enables the support bracket 12 to be quickly and easily removed from and replaced on the wall, as may be desired for maintenance and replacement. It should be noted that the depicted surface-mountable bracket 22 is shown in two different shapes/forms in FIGS. 2 and 3, but they function essentially the same way. Also, the depicted rear panel 20 has a flat continuous sheet configuration but can be provided in another form (e.g., a frame) that provides the functionality described herein.

In other embodiments, a rail-and-receptacle mounting system is provided in a vice versa arrangement, with the receptacle in the support bracket and the rail on the surface-mountable bracket. Other embodiments include other conventional two-part or one-part mounting systems that function to removably or permanently mount the support bracket 12 to a wall or other surface. Such other embodiments can include for example double-sided tape or adhesives applied to the surface and the rear side of the support bracket 12, or holes extending front-to-rear through the support bracket that receive mounting screws or other fasteners that can be installed into the wall or other surface.

In some embodiments, the rail-and-receptacle mounting system includes a locking mechanism including elements of the support bracket 12 and mounting bracket 22 that releasably engage each other to lock the two parts together. The locking mechanism also includes a key (not shown) that inserts into a keyhole 26 of the mounting bracket 22 to contact and displace one or both of the engaging elements from inter-engagement to release the support bracket 12 from locking engagement with the surface-mounted bracket 22. The same or a separate key may be used to release the shell 16 from locking engagement with the support bracket 12, as discussed below.

Referring additionally to FIGS. 4-7, the support bracket 12 includes an upper panel 28 extending forward from an upper portion of the rear panel 20 and having a recess 30 formed in it. The recess 30 is forward-facing, that is, it's open/accessible at and extends laterally through a front edge of the upper panel 28, and the recess 30 is vertically open, that is, it extends vertically all the way through the upper panel 28. The recess 30 can be used to removably mount/couple the dispenser assembly 14 to the support bracket 12, as described in more detail below. The interior surface of the recess 30 can be sized and/or shaped (e.g., serrated) so that the dispenser assembly 14 snaps into place. The depicted upper panel 28 conceals the container 13 from the top, and can assist in supporting the dispenser assembly 14 on the support bracket 12 (the dispenser assembly 14 of this embodiment is suspended from the upper panel 28). In other embodiments, the upper panel is a clip (e.g., a U-shaped resilient member), or has another configuration (e.g., arms, tabs, or structural members), that forms the recess and provides the container-mounting functionality.

In addition, the support bracket 12 can include a lower panel 32 extending forward from a lower portion of the rear panel 20 and positioned spaced apart and opposite from the upper panel 28. In the depicted embodiment, the lower panel 32 encloses and conceals the container 13 from the bottom, and acts as a shelf that assists in supporting the dispenser assembly 14 on the support bracket 12 (the dispenser assembly 14 of the depicted embodiment includes a pouch container 13 can rest upon the lower panel 32). In other embodiments, the lower panel is excluded. And in yet other embodiments, the lower panel has another form (e.g., one or more arms, tabs, or other structural members) that provides the container-support functionality but not the container concealment functionality.

Furthermore, the support bracket 12 can include side retaining ribs 34 extending forward from laterally opposite outer side portions of the rear panel 20. The retaining ribs 34 can be tabs, panels (e.g., extending the entire vertical length of the bracket), or other protrusions that cooperate with the rear panel 20 (and the upper and lower panels 28 and 32) to form an interior space for housing the container 13 of the dispenser assembly 14. In this way, the support bracket 12 forms a cage-like structure that cooperates with the shell 16 to substantially conceal/obscure the container 13 and the rest of the support bracket when mounted for use. The retaining ribs 34 hold the container 13 in place to prevent it from lateral displacement from the interior space. And some of the retaining ribs 34 can have a front portion extending across the front of the support bracket 12, for example the depicted two laterally opposite lower ribs 34, to hold the container 13 in place to prevent it from forward displacement from the interior space.

The dispenser assembly 14 includes the container 13 and the delivery mechanism 15 coupled together for use, as noted. The container 13 and the delivery mechanism 15 can be coupled together directly (without a coupling between them) or indirectly (with a coupling between them). The container 13 holds the personal-hygiene fluid to be dispensed by the delivery mechanism 15 for use. In the depicted embodiment, the container 13 is a collapsible pouch, though in other embodiments it can be a bottle, vessel, or other receptacle capable of containing the personal-hygiene fluid. As such, the container 13 can be of a conventional type well known in the art. Also, the container 13 can include a label area for providing a description of its contents.

The delivery mechanism 15 of the depicted embodiment is a manually operated pump assembly including a dip tube (not shown) extending to the bottom interior portion of the container 13, a dispensing spout 35 through/from which the personal-hygiene fluid is delivered for use, and a fitting (e.g., threaded) 36 between them to connect to the container 13. Other embodiments can include other delivery mechanisms suitable for use in dispensing personal-hygiene or other fluids. As such, the delivery mechanism 15 can be of a conventional type well known in the art.

The container 13 and the delivery mechanism 15 can be detachably coupled together by a coupling so that the container 13 can be disposable and the delivery mechanism 15 reusable (or so that the container 13 can be refillable and reusable along with the delivery mechanism 15). In the depicted embodiment, the dispenser assembly 14 includes a collar 38 with a lower attachment (e.g., a band) 40 permanently affixed (e.g., peripherally bonded by adhesives, heat sealing, or other techniques) to the container 13 (e.g., annularly at its mouth) and an upper fitting (e.g., threaded) 42 that detachably couples to the fitting 36 of the delivery mechanism 15 (the fittings 36 and 42 form the coupling). In this way, the delivery mechanism 15 can be detachably/removably connected to the collar 38 and thus the container 13.

Thus, the delivery mechanism 15 and the container 13 can be coupled together during use and decoupled after use for replenishment (replacement or refilling) of the container 13. In applications in which a spent container 13 is removed and replaced with a full new container 13, for example for a pouch container 13 with the collar 38 permanently attached to it (as depicted), the replacement pouch containers 13 can be provided with a cap (e.g., threaded) 44 that removably connects to the collar fitting 42 to seal the container 13 during storage/transport of the container 13 before and after use (see FIG. 6). Also, in some embodiments, the container 13 and the collar 38 are provided as a single integral piece (e.g., where the container is a rigid bottle).

In addition, the dispenser assembly 14 removably mounts to the support bracket 12. Thus, the dispenser assembly 14 can be mounted in place to the support bracket 12 for dispensing use, and then removed from the support bracket 12 for replenishment. After replenishment, the dispenser assembly 14 (with the same container refilled or with a new/different full one) can be remounted back into place on the support bracket 12 for additional dispensing use. For example, the collar 38 can additionally include a mid-portion (between the lower attachment band portion 40 and the upper fitting portion 42) that removably mounts to the recess 30 of the upper panel 28 of the support bracket 12. In other embodiments, another portion of the dispenser assembly 14 removably mounts to the same or another portion of the support bracket 12.

The collar mid-portion can include at least one flange 46 and at least one neck 48 immediately adjacent the flange 46, with the flange 46 laterally outwardly extending and having a lateral (e.g., radial) dimension that is greater than the lateral (side-to-side) dimension of the upper-panel recess 30 of the support bracket 12, and with the neck 48 having a lateral (e.g., radial) dimension that is less than the lateral dimension of the upper-panel recess 30. As such, the dispenser neck 48 can be laterally (front-back) inserted into and removed from the bracket recess 30 to install and remove the dispenser assembly 14 relative to the support bracket 12. But the flange 46 interferes with the upper panel 28 to prevent vertical/axial movement of the installed dispenser assembly 14 relative to the support bracket 12.

Typically, two of the flanges 46 are provided in a spaced-apart arrangement with the neck 48 positioned/sandwiched between them to form a channel, as depicted. In this way, the channeled neck 48 is received in the bracket recess 30, and at the same time the upper panel 28 is received in the channeled neck 48 and sandwiched between the flanges 46. The two flanges 46 thus secure the dispenser assembly 14 from vertical/axial movement up or down relative to the support bracket 12. For example, this provides resistance for depressing the manual push-pump of the delivery mechanism 15 and prevents the collapsible pouch container 13 from moving/collapsing downward during pumping/dispensing use, prevents the collapsible pouch container 13 from being pulled upward through the recess 30, and generally secures the dispenser assembly 14 in place during use.

As such, in the depicted embodiment, the pouch container 13 is supported in suspension from the interface/coupling of the dispenser neck 48 and the bracket recess 30, and is supported from below by resting upon the lower panel 32 of the support bracket 14. In other embodiments, a rigid container (e.g., a plastic bottle) is retained in place laterally, but not suspended, by the interface/coupling of the dispenser neck 48 and the bracket recess 30, and is supported from below by resting upon the lower panel 32 of the support bracket 14. In yet other embodiments, the container 13 is supported from below by resting upon the lower panel 32 of the support bracket 14, and is retained in place laterally, but not suspended, within the shell notch 54 (detailed elsewhere herein), without being received and retained in any bracket recess (the bracket recess 30 need not be included in such embodiments). And in still other embodiments, the container 13 is supported and suspended at the interface/coupling of the dispenser neck 48 and the bracket recess 30, but not supported from below.

In some embodiments, the dispenser neck 48 and the bracket recess 30 are configured (sized and shaped) to provide a snap-fit connection. The depicted flanges 46 are annular panels (thus forming an annular channeled neck between them), though in other embodiments they can have other configurations (e.g., regular or irregular tabs or wings) to provide the functionality described herein. In yet other embodiments, another part of the dispenser assembly 14 (e.g., a part of the delivery mechanism or the part of the container itself) removably mounts to the recessed upper panel 30 of the support bracket 12. And in still other embodiments, the channeled neck 48 of the dispenser assembly 14 removably mounts to another part of the support bracket 12 (e.g., a recess on another part of the support bracket).

Referring additionally to FIGS. 8-23, the cover shell 16 removably mounts to the support bracket 12 so that when mounted in place the shell 16 and the bracket 12 cooperate to enclose and conceal (at least substantially obscure, except for the viewing window) the container 13 of the dispenser assembly 12 during use, and when the shell 16 is removed the dispenser assembly 12 can be accessed for replenishing the container 13. For example, the shell 16 and the support bracket 12 can be vertically slidably mounted to each other, so that the shell 16 can slide onto and over the support bracket 12 and the dispenser assembly 12 without disturbing or interference from the container 13 or the delivery mechanism 15. In some such embodiments, the shell 16 has front and side portions that cooperate with the support bracket 12 to enclose and conceal/obscure the container 13 (as depicted), and in other such embodiments the shell is simply a front panel that slides (vertically or otherwise) to cover or expose a front opening in an otherwise enclosed support bracket. In other embodiments, the shell 16 and the support bracket 12 can be removably mounted to each other by other conventional features, such as a clam-shell arrangement (of the shell and bracket), a pivotal or hinged connection of the shell to the bracket (the shell can remain physically contacting the bracket at the pivot), or latch mechanism that removably couples together the shell and bracket. And in still other embodiments, the shell at least partially mounts to a portion of the dispenser assembly.

In the depicted embodiment, the shell 13 includes a housing member 50 that encloses the front portion and two opposing side portions of the container 13, with a top side 52 (extending across the top of the housing) having a notch (recessed opening) 54 through which the delivery mechanism 15 extends, with a bottom opening 56 through which the bracket 12 and container 13 can be slid, and with slide surfaces 58 that slidably engage cooperating slide surfaces 60 of the support bracket 12. The housing 50 can be a continuous sheet of thin material that is generally C-shaped in longitudinal cross section (see, e.g., FIGS. 14 and 19). In other embodiments, the housing can have another regular or irregular shape (e.g., rectangular or polygonal) and includes a front portion and two opposing side portions.

The shell housing 50 is sized and shaped, relative to the support bracket 12, to fit snugly over and onto the support bracket 13 in a nested arrangement. In the depicted embodiment, a front portion of the housing 50 extends across and covers the front portion of the container 13, and two opposing side portions of the housing 50 extend rearwardly from its front portion across and cover the two opposing side portions of the container 13 and the side retaining ribs 34 of the support bracket 12. The two side portions of the housing 50 have a front-rear dimension that is about the same as that of the two opposing side ribs 34 with the front extensions to provide the snug fit. The shell housing 50 can thus be considered to have front and side portions for purposes of defining the snug nested fit even in embodiments in which the housing is curved, as depicted.

The top 50 of the shell 16 can be tapered upward and include a shroud portion 62 (e.g., a tubular or conical section, collar, or other peripheral member) that defines the notch 54 and that surrounds and prevents access to the fitting 36 of the delivery mechanism 15 to prevent detaching the delivery mechanism 15 from the container 13 when the shell 16 is mounted onto the bracket 12. That is, the shroud 62 extends upward to adjacent the top of the fitting 36 of the delivery mechanism 15 so that users (average adult humans) cannot access the fitting 36 in the notch 54 directly with their fingers (without using a special tool). The shroud 62 (and notch 54 defined by it) can have a shape generally conforming to the shape of the fitting 36 and a size that is slightly larger.

The top notch 54 is elongated (in a forward/rearward orientation) and U-shaped (with its open side in communication with a rear opening 64 of the shell 16). The elongated top notch 54 is configured to receive (vertically slide through it) the dispensing spout 35, which extends laterally relative to the fitting 42, when the spout 35 is rotated to a rear-facing clearance position (see, e.g., FIG. 8), but not when the spout 35 is its forward-facing use position (see, e.g., FIG. 23). That is, when the spout 35 is in its rearward-extending clearance position it does not interfere with the shell top 50 when the shell 16 is slid onto the support bracket 12 (the spout 35 can fit/slide through the open side of the notch 54), but when the spout 35 is in its forward-extending use position it interferes with the shell top 50 when the shell 16 is slid onto the support bracket 12. As such, the spout 35 can be rotated at least 180 degrees (typically 360 degrees) relative to the pouch/container 13, so it can be swung from forward facing for use, to rearward facing for clearance from the shell 16, and back.

Figure 9:
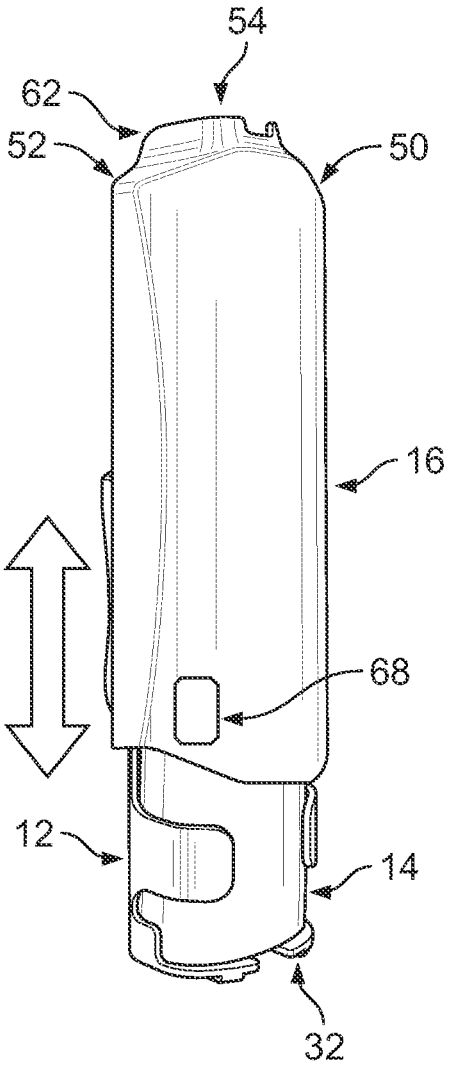
FIG. 9 shows the dispensing system of FIG. 8 with the shell being vertically slid onto the support bracket and dispenser assembly.
Figure 10:
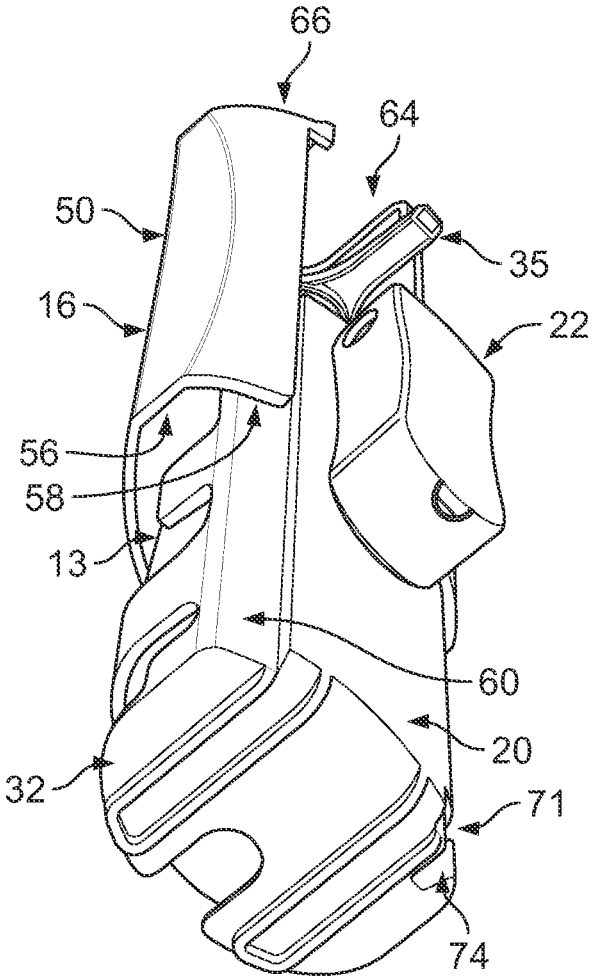
FIG. 10 is another perspective view of the dispensing system of FIG. 8 with the shell being vertically slid onto the support bracket and dispenser assembly.
Figure 11:
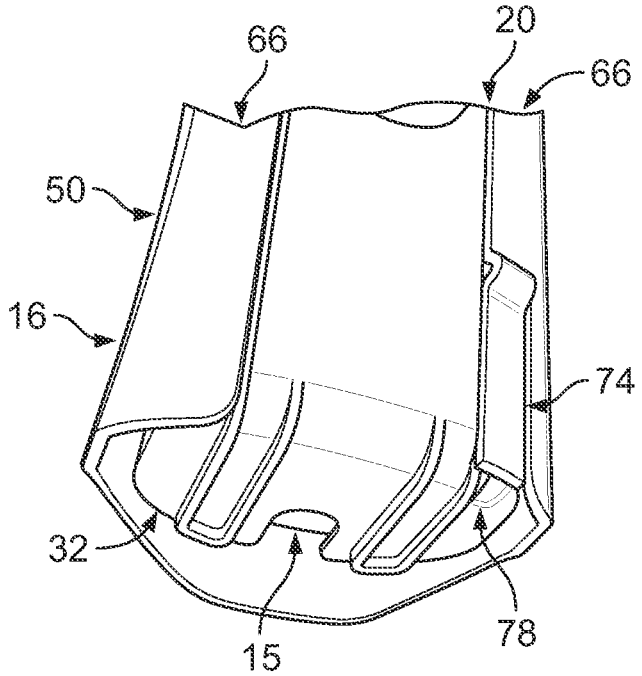
FIG. 11 is another perspective view of a portion of the dispensing system of FIG. 8, showing the shell slid vertically all the way onto the support bracket and dispenser assembly to a use position.
Figure 13:
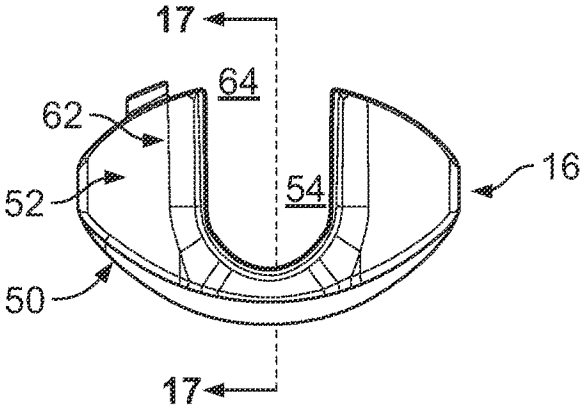
FIG. 13 is a top view of the shell of FIG. 12.
Figure 14:
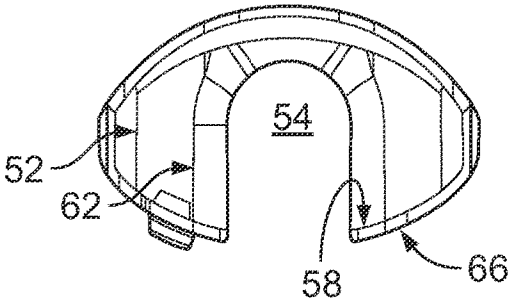
FIG. 14 is a bottom view of the shell of FIG. 12.
Figure 12:
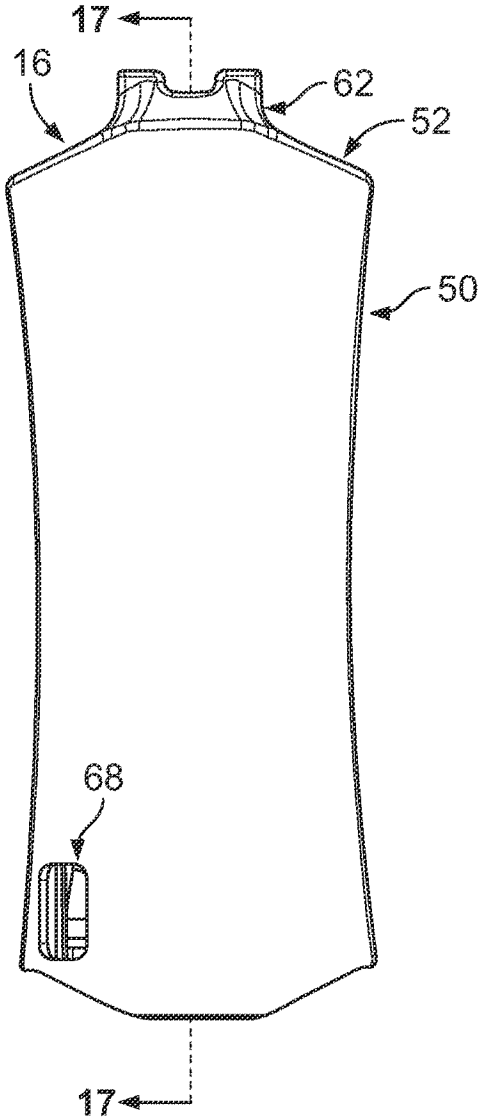
FIG. 12 is a front view of the shell of FIG. 1.
Figure 18:
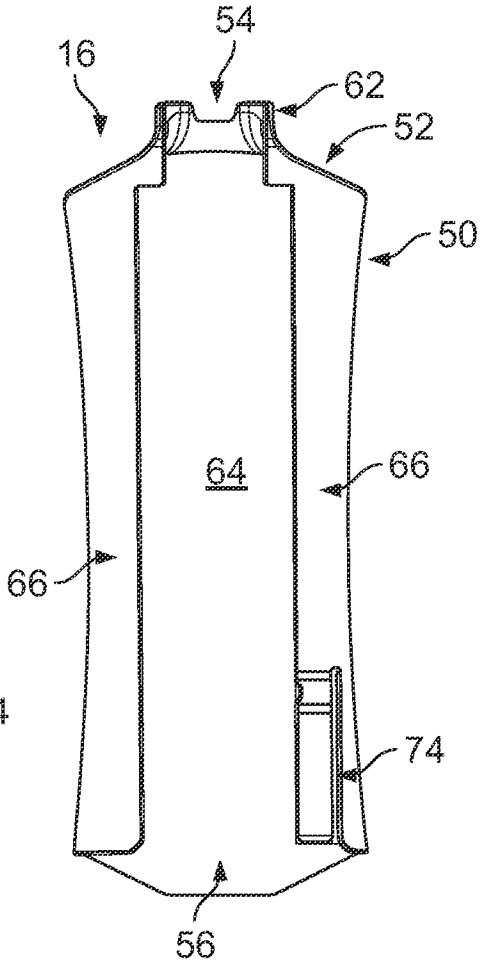
FIG. 18 is a rear view of the shell of FIG. 12.
Figure 17:
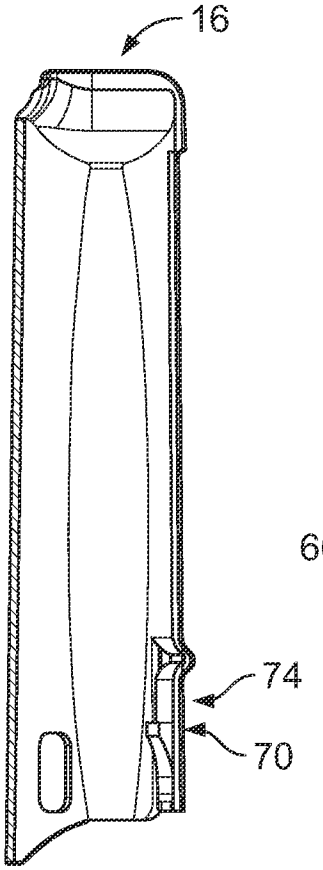
FIG. 17 is a cross-sectional view of the shell of FIG. 12 taken at line 17-17.
Figure 16:
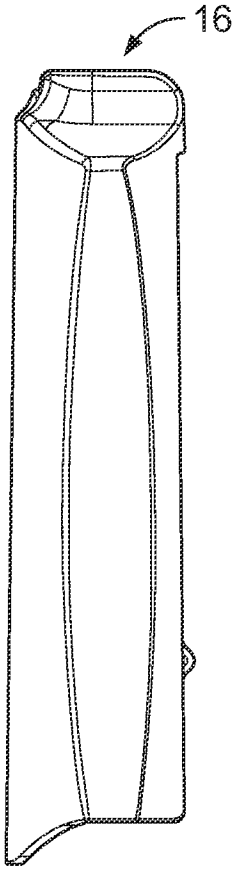
FIG. 16 is a right side view of the shell of FIG. 12.
Figure 15:
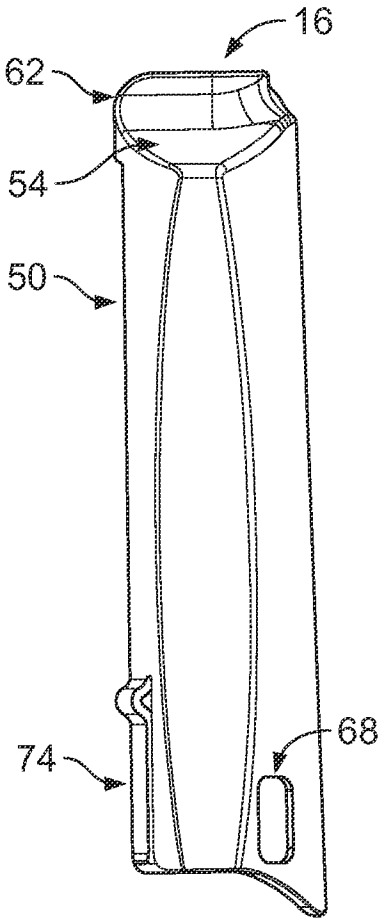
FIG. 15 is a left side view of the shell of FIG. 12.

The bottom opening 56 of the shell 16 is configured to receive (vertically slide over) the bracket 12 and the container 13 mounted to the bracket 12 (see, e.g., FIGS. 9-11). That is, the bracket 12 and the bracket-mounted container 13 can be slid vertically relative to the shell 16, through the bottom opening 26 of the shell 16 without interference.

Figure 19:
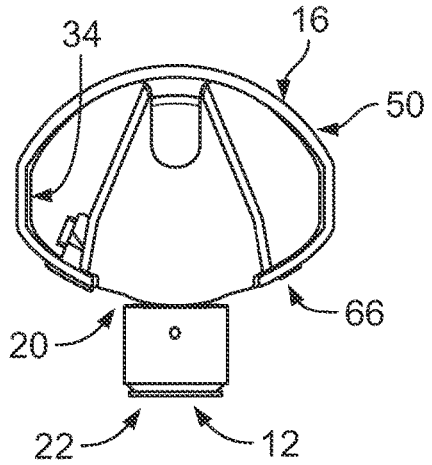
FIG. 19 is an end view, schematically and cross-sectionally, of the shell and the support bracket of FIG. 1, showing these parts mounted together.
Figure 20:
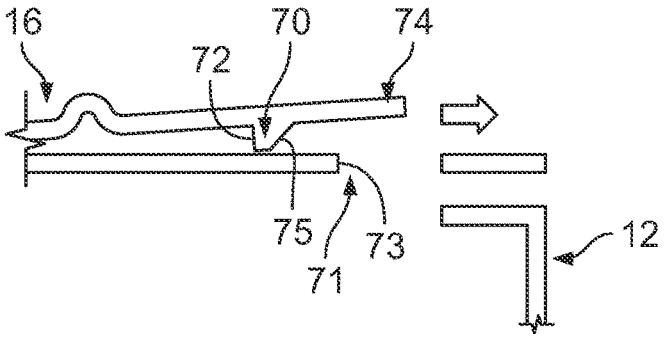
FIG. 20 is a side detail view, schematically and cross-sectionally, of a portion of the shell and the support bracket of FIG. 1, showing these parts being mounted together.

The slide surfaces 58 of the shell 16 can be formed on lips 66 that extend inwardly toward each other from opposite sides of the shell housing 50 (see, e.g., FIGS. 10 and 19). In the depicted embodiment, there are two slide lips 66, each extending along the entire vertical length of the shell 16, though in other embodiments each lip can be provided by one or a series of tabs, fingers, or other protrusions, and/or only one sliding lip can be included. The two slide lips 66 can extend inwardly toward each other from opposite rear edges of the housing 50, as depicted. The two slide lips 66 do not extend all the way across and enclose the rear of the shell 16, instead they form a vertical rear opening 64 of the shell 16 between them. The vertical rear opening 64 of the shell 16 slidingly receives the portion of the support bracket 12 that mounts to the wall or other surface (e.g., the rail 18 and mounting bracket 22). In the depicted embodiment, the shell rear opening 64 extends vertically the entire length of the shell 16 so that the shell 16 can be vertically slid over the rear-facing spout 35 of the delivery mechanism 15.

As noted above, the slide surfaces 58 of the shell 16 are slidingly engaged by the slide surfaces 60 of the support bracket 12. The slide surfaces 60 of the support bracket 12 are typically formed on the rear of the rear panel 20, in a spaced-apart (and co-planar) arrangement, with a wall/surface-mounting element (e.g., the rail 18 and mounting bracket 22) positioned between them. The slide surfaces 60 of the support bracket 12 are positioned to be slidingly engaged by the slide surfaces 58 of the shell 16 to enable the shell 16 to be vertically slid onto and off of the support bracket 12, with the shell 16 and the support bracket 12 coupling together in a nested arrangement with a snug fit, without interference with any wall/surface-mounting element (e.g., rail 18 or bracket 22). In the depicted embodiment, there are two continuous flat slide surfaces 60, each extending along the entire vertical length of the bracket 12, though in other embodiments each can be undulating or have another contour. In other embodiments, the slide surfaces 60 of the support bracket 12 are formed on opposing sides of the bracket 12 (e.g., on the side ribs 34 or other side panels), and the cooperating slide surfaces 58 of the shell 16 are formed on side portions of the housing 50, to provide the same functionality described herein. These and other included embodiments can have male-female sliding features, for example, with the slide surfaces formed on or by vertical rails or slots.

In addition, the shell 16 can include a viewing window 68 to enable visually observing when the fluid level in the container 13 is low and replenishment is needed. The viewing window 68 can be an aperture in the shell 16 or a clear (transparent or translucent portion) portion of it.

Furthermore, the shell 16 can be releasably locked to the support bracket 12 to prevent unauthorized removal of the shell 16 and accessing of the container 13 (e.g., for tamper-resistance in public and/or hospitality environments). To provide this functionality, a locking system includes two contact surfaces, with one on the shell 16 and the other on the support bracket 12, that releasably engage each other to secure the parts together and selectively release them for separation (e.g., by vertical sliding).

In the depicted embodiment, the shell 16 includes a spring tab structure includes a protrusion (e.g., a boss or tab) 70 and the support bracket 12 includes an aperture 71 that receives the protrusion 70 in a locked position to secure the shell 16 and bracket 12 together. The protrusion 70 has a contact surface 72 and the aperture 71 defines a contact surface 73 of the support bracket 12, with the two contact surfaces 72 and 73 providing the releasable locking engagement feature. The protrusion 70 is spring-biased into locking engagement with the aperture 71, for example by being formed on a resiliently deflectable cantilevered arm 74 extending from the shell 16 (as depicted), or by a coil spring or other spring element.

Figure 21:
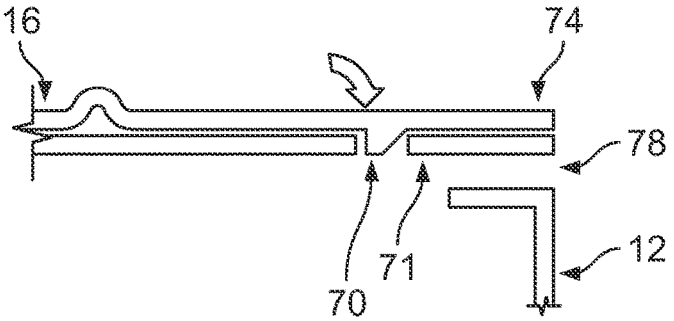
FIG. 21 shows the shell and support bracket of FIG. 20 fully mounted and locked together.
Figure 22:
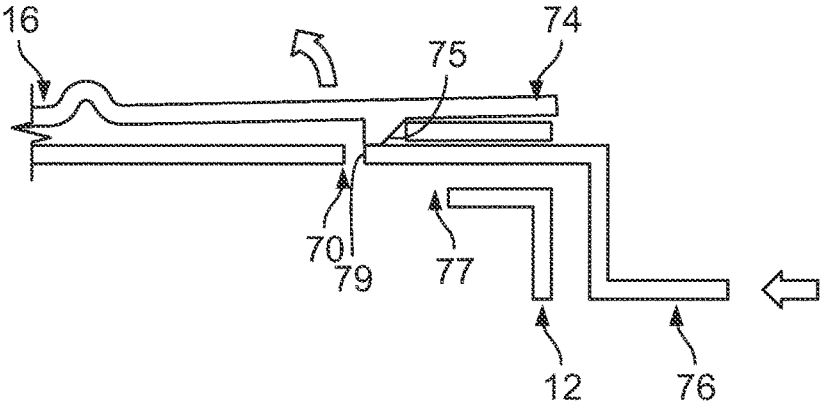
FIG. 22 shows the shell and support bracket of FIG. 20, showing the shell being released/unlocked from the support bracket.

The protrusion 70 is displaced to its charged position (e.g., by the arm 74 resiliently deflecting upon displacing engagement with the shell 16) while the shell 16 is installed (see FIG. 20), and the protrusion 70 engages with and seats into the aperture 71 (by the arm 74 resiliently discharging and returning to its neutral position when the protrusion is aligned with the aperture 71) when the shell 16 is fully installed onto the support bracket 12 in the use position (see FIG. 21). The protrusion 70 can include a release surface 75 (e.g., oppositely facing from its contact surface 72) that can be engaged by a key 76 to apply mechanical leverage to forcibly displace the protrusion 70 from its neutral locked position to its displaced unlocked/released position clear of the aperture 71 (see FIG. 22). The release surface 75 can be ramped (e.g., linearly, curved, or otherwise inclined) so that when the key 76 is moved linearly into contact with it, the ramped release surface 75 deflects the protrusion 70, as depicted. Also, the ramped release surface 75 deflects the protrusion 70 to its charged position upon contact with the shell 16 when the shell 16 is vertically slid down onto the bracket 12. This displacing/charging of the protrusion 70 is enabled by the shell 16 and the bracket 12 slidingly nesting together with a snug fit.

The key 76 includes a key blade 77 that inserts into a keyhole 78 formed in the support bracket 12 to access the release surface 75, with the leading tip 79 of the key blade 77 contacting the release surface 75 to displace the protrusion 70 from the aperture 71. As such, the key blade 77 is typically elongated and generally linear, and does not need to include any cuts or wards. The release surface 75 is located internally within the interior space defined by the shell 16, with this surface a sufficient distance from the entrance of the keyhole 78 and with the keyhole 78 having a configuration (i.e., shape and size) to provide tamper-resistance. That is, an adult or child finger cannot be inserted into the keyhole 78 to reach and displace the release surface 75 to unlock and remove the shell 16, and instead a special tool (e.g., the key 76) is required to unlock and remove the shell 16.

Furthermore, in embodiments including this shell-to-bracket locking system and also including a locking system that secures the support bracket 12 to a mounting bracket 22, the two locking systems can be of the same or a similar design such that the key 76 for this locking system can also be used to release the support bracket 12 form the mounting bracket 22 (i.e., a single key 76 can be used for both locking systems).

This locking feature also functions to position the shell 16 relative to the support bracket 12. That is, when the protrusion 70 snaps into the aperture 71 to lock the shell 16 from being slid off the bracket 12, the shell 16 is also locked from being slid further into the bracket 12. As such, the engaging contact surfaces 72 and 73 support the shell 16 on the support bracket 12. In other embodiments, the shell top 50 can rest upon the bracket upper panel 28 or the delivery mechanism fitting 36 to support the shell 16 in place on the bracket 12.

In other embodiments, the contact surfaces are in a vice versa arrangement, with the protrusion on the support bracket (or the mounting bracket) and the aperture in the shell. And in other embodiments, the locking feature is provided by other structural locking elements that include two engaging contact surfaces, for example bolt locks, cam locks, or latches.

Figure 23:
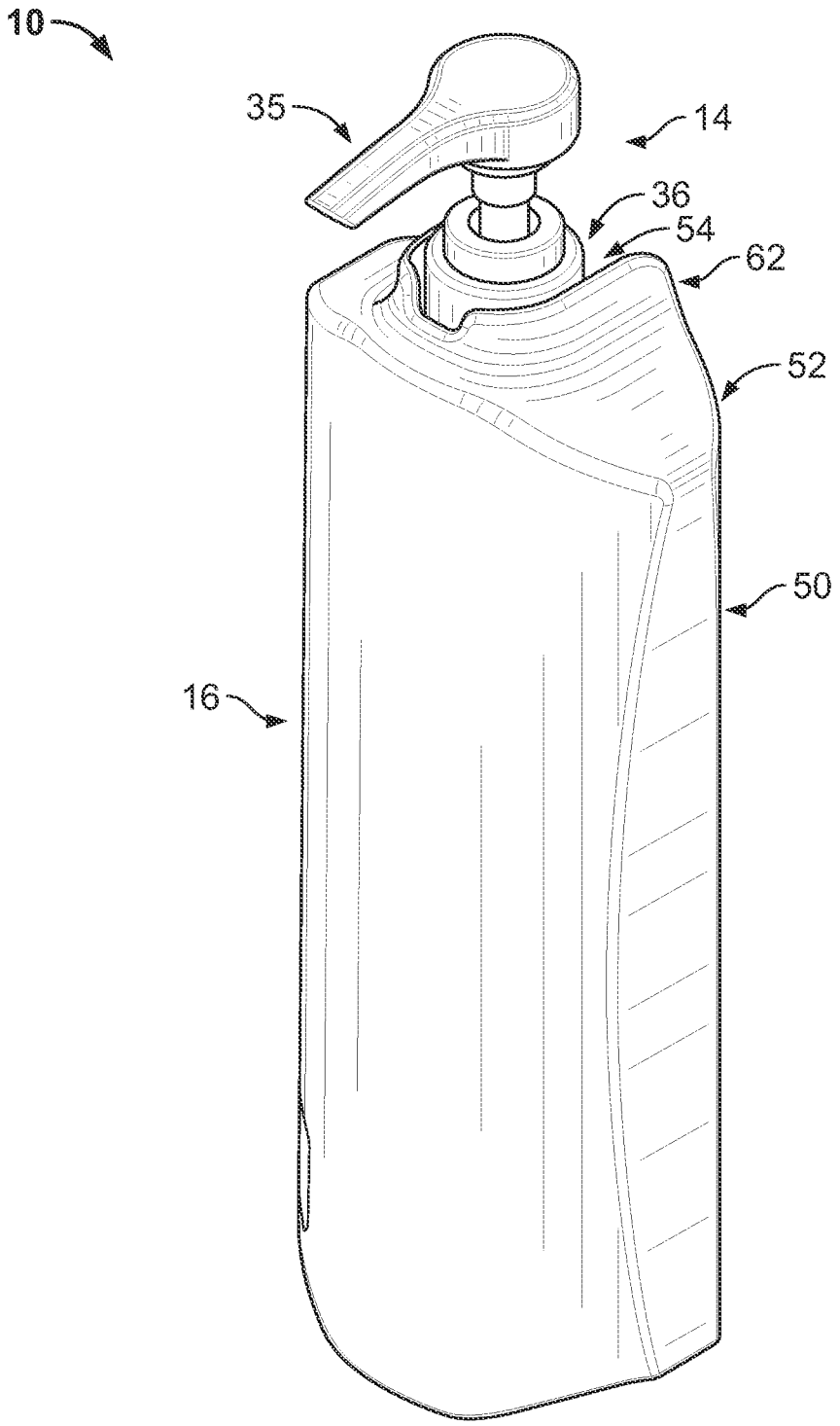
FIG. 23 is a perspective view of the assembled dispensing system of FIG. 1 ready for use.
Figure 24:
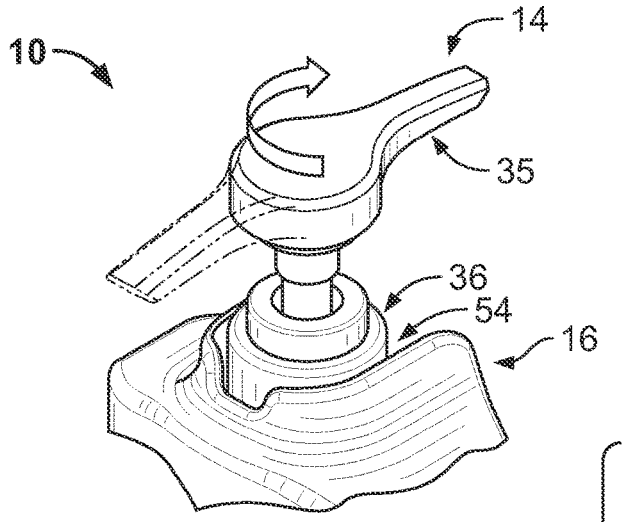
FIG. 24 is a perspective detail view of a portion of the dispensing system of FIG. 23, showing the spout being repositioned during a replenishing method.
Figure 25:
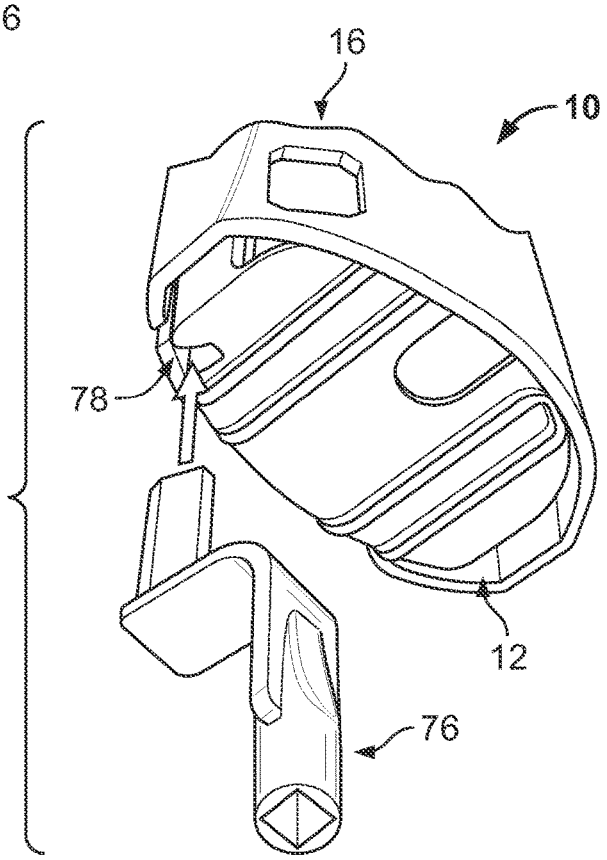
FIG. 25 is a perspective detail view of a portion of the dispensing system of FIG. 23, showing a key positioned for unlocking use during the replenishing method.
Figure 26:
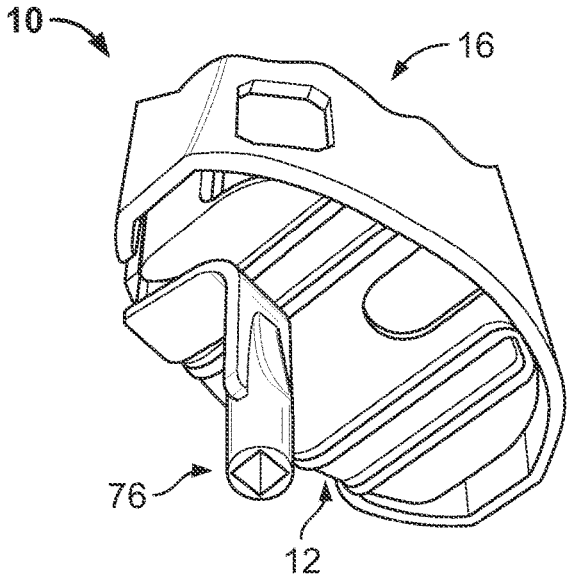
FIG. 26 shows the portion of the dispensing system of FIG. 25 with the key inserted into a keyhole for unlocking use during the replenishing method.
Figure 27:
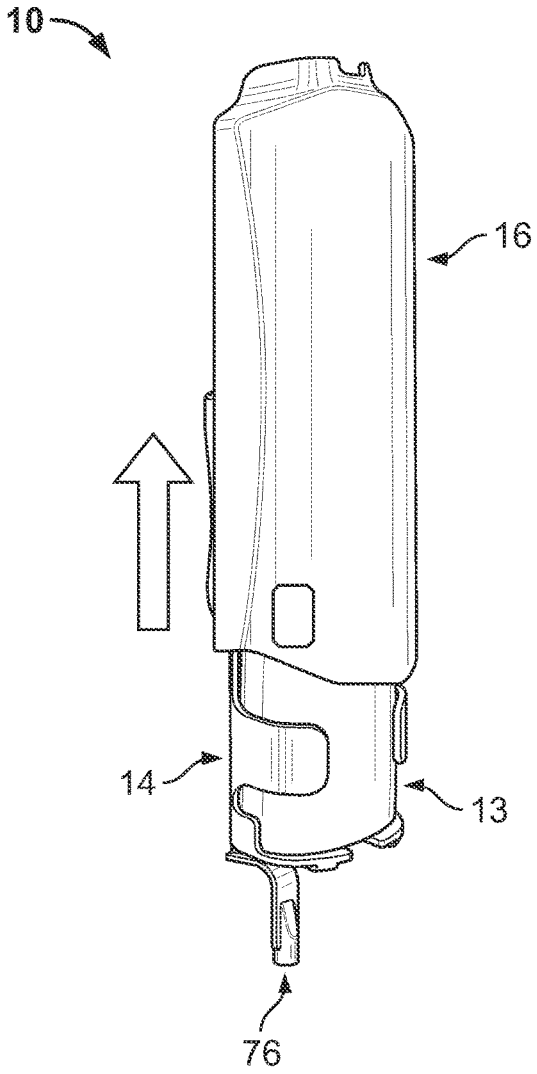
FIG. 27 is a perspective view of the dispensing system of FIG. 23, showing the released/unlocked shell being removed from the support bracket during the replenishing method.
Figure 28:
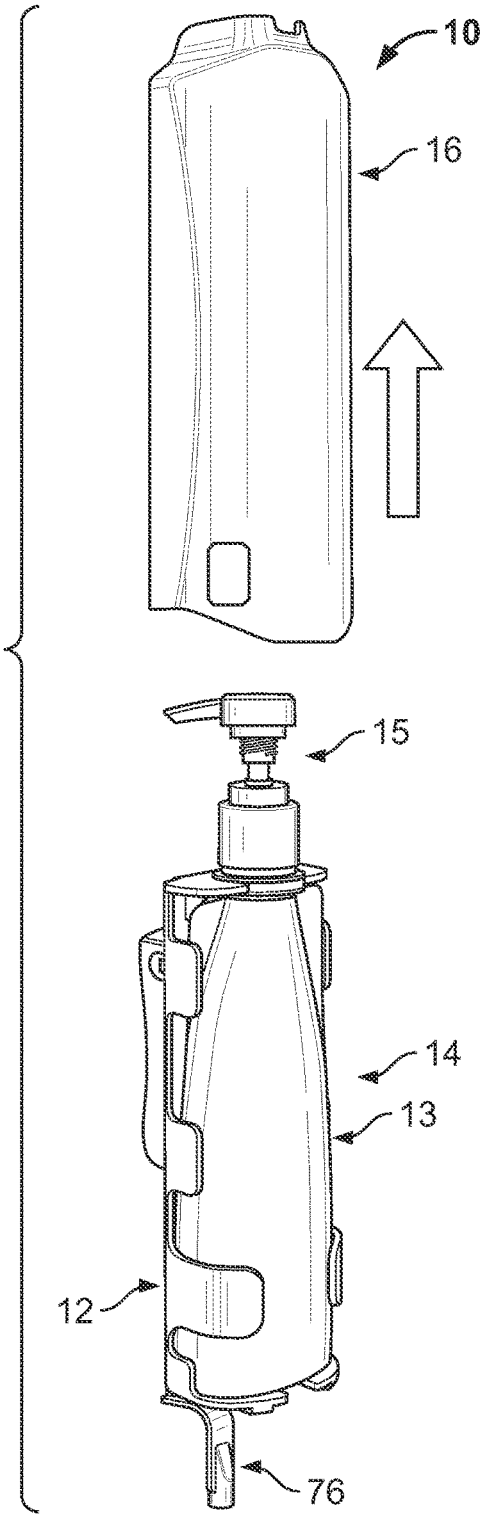
FIG. 28 shows the dispensing system of FIG. 27 with the shell fully removed from the support bracket to expose the container for replenishment during the replenishing method.

FIG. 23 shows the installed and assembled dispensing system 10, with the shell 16 mounted to and concealing the support bracket (not visible) and the container 13 (not visible) of the dispenser assembly 14, and with the spout 35 exposed and accessible for use in dispensing the personal-hygiene fluid.

Referring additionally to FIGS. 24-28, in another aspect, the invention relates to a method of replenishing a mountable replenishable dispensing system for personal-hygiene fluids. The method is described herein being implemented using the depicted dispensing system 10, though it can be implemented using other dispensing systems that provide substantially the same functionality.

The replenishing method can be performed when a maintenance person sees that the personal-hygiene fluid in the container 13 of the dispensing system 10 is at a low level or has been extinguished/depleted. To replenish the dispensing system 10 with fresh personal-hygiene fluid product, the dispenser spout 35 is rotated from its front/use position to its rear/clearance position (in vertical alignment with the open side of the notch 54) (see FIG. 24) and the shell 16 is removed from the support bracket 12 to expose/access the dispenser assembly 12. In embodiments in which the shell 16 is releasably locked to the support bracket 12, the shell removal includes first releasing the shell 16 from locking engagement with the support bracket 12, for example by inserting the key 76 into the keyhole 78 of the bracket 12 to displace the contact surfaces from locking engagement (see FIGS. 25-26). In the depicted embodiment, the shell removal includes sliding the shell 16 vertically relative to the support bracket 12 (see FIGS. 27-28).

The dispenser assembly 16 is then removed from the support bracket 12, for example by moving the collar 38 laterally forward out of the bracket recess 30. The delivery mechanism (e.g., hand pump assembly) 15 is then separated from the container 13, and the container (with the attached collar 38) is replenished, either replaced with a new/full container/collar (with the depleted container/collar disposed of or recycled) or refilled for reuse. The delivery mechanism 15 is then reattached to the container 13, the reassembled dispensing assembly 14 is then remounted to the support bracket 12, the shell 16 is then reinstalled onto the support bracket 12, and the spout 35 is rotated back to it forward/use position (i.e., the disassembly process is reversed).

In method embodiments in which the same container 13 is refilled with the fluid, the delivery mechanism 15 can be removed from the container 13 for refilling, and reinstalled after refilling, while the container 13 is still mounted to the support bracket 12. In other method embodiments, the entire dispenser assembly 14, including the container 13 (with the collar 38) and the delivery mechanism 15, can be replaced (in such embodiments, the container and the delivery mechanism can be permanently attached together, instead of being separable from each other).

In another aspect, the invention relates to a replacement container holding a personal-hygiene fluid for use in a replenishment system and method. The replacement container can be provided by the container 13 and collar 38 of the depicted dispensing system 10, or by containers and container mounts of other dispensing systems that provide substantially the same functionality. In this way, the support bracket 12 can remain mounted to the wall for long-term use, and the shell 16 can be removed from and reinstalled onto the bracket 12 for long-term use, with the replacement fluid container 13 replenished sequentially over time using the replenishment method. Such replacement containers 13 can be disposable and replaced with full new containers, or they can be refillable and reused.

FIGS. 29-38 show details of a dispenser assembly-to-bracket removable-mounting interface/coupling of a dispensing system 110 according to a second example embodiment. The dispensing system 110 of this embodiment can be the same, or substantially the same, as that of the embodiments described above, except with the differences noted herein. As such, the dispensing system 110 includes a support bracket 112, a dispenser assembly 114 (including a container 113 and a delivery mechanism (not shown)) that removably mounts to the support bracket 112, and a cover shell (not shown) that removably mounts to the support bracket 112 to cover and conceal/obscure the container 113 during use.

In this embodiment, the collar 138 of the dispenser assembly 114 includes a midsection with two spaced-apart flanges 146 defining a peripheral channel/neck 148, and the support bracket 112 includes a recess 130, with these components forming the dispenser-bracket interface/coupling as in the above-described embodiments, but with these components having a modified design from the above-described embodiments. It should be noted that the modified structural arrangements of the other/alternative embodiments described above can be incorporated into the dispensing system 110 of this embodiment.

Figure 29:
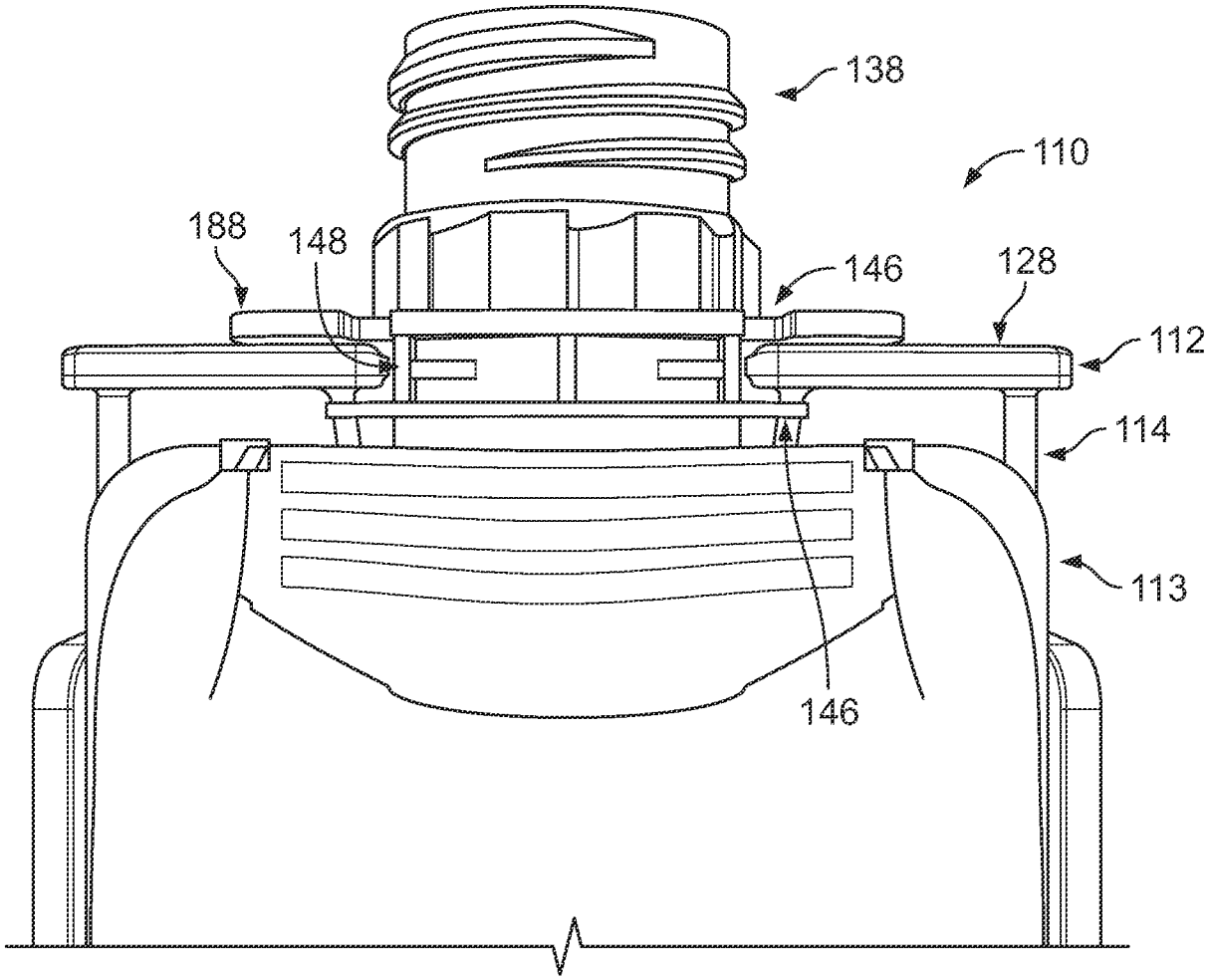
FIG. 29 is a front side detail view of a portion of a dispensing system according to a second example embodiment, showing a dispenser assembly mounted to a support bracket.
Figure 30:
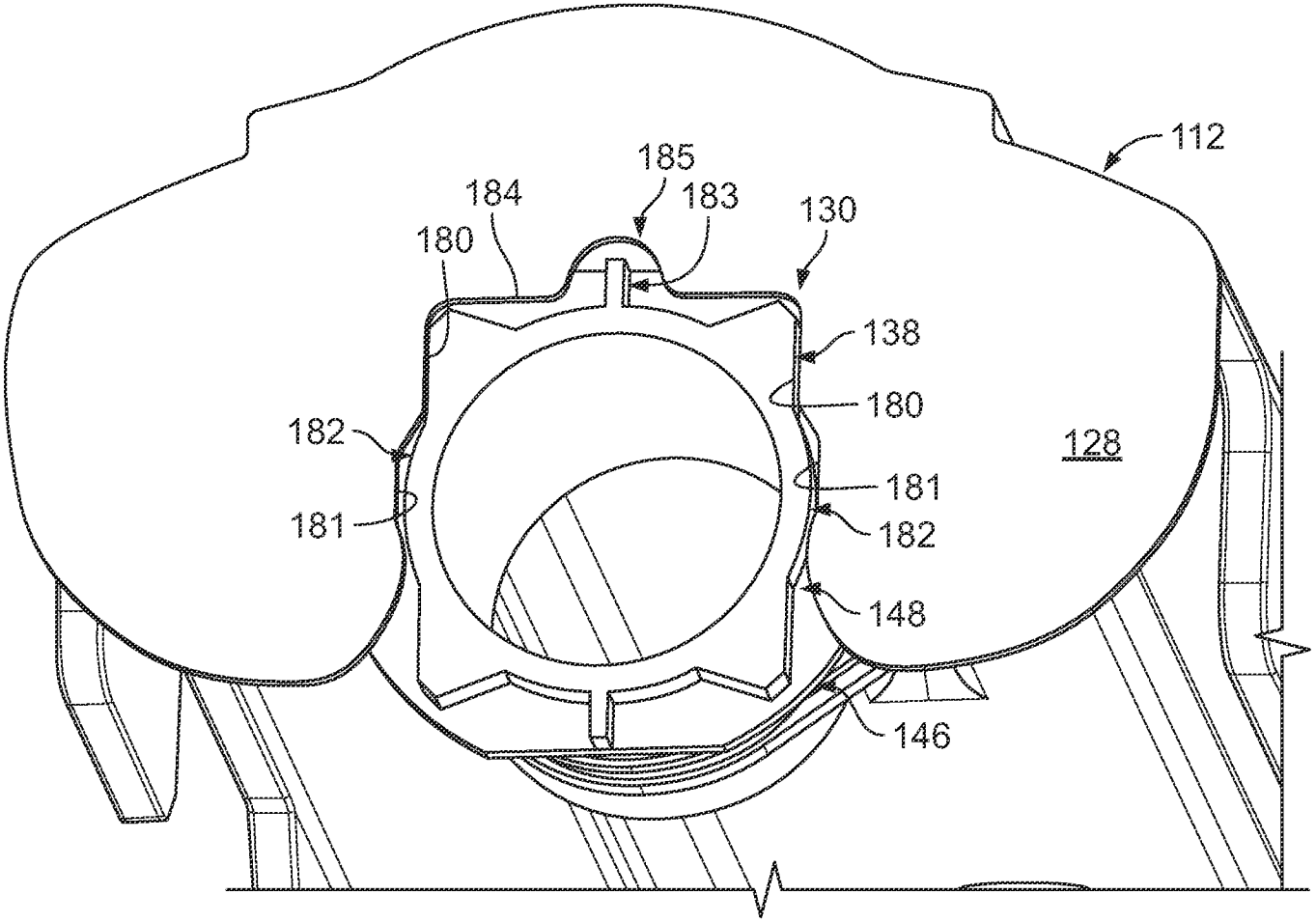
FIG. 30 is a perspective detail view of a portion of the dispensing system of FIG. 29, showing details of the interface/coupling of the dispenser assembly to the support bracket, with a collar of the dispenser assembly shown in cross section through its channeled neck.
Figure 31:
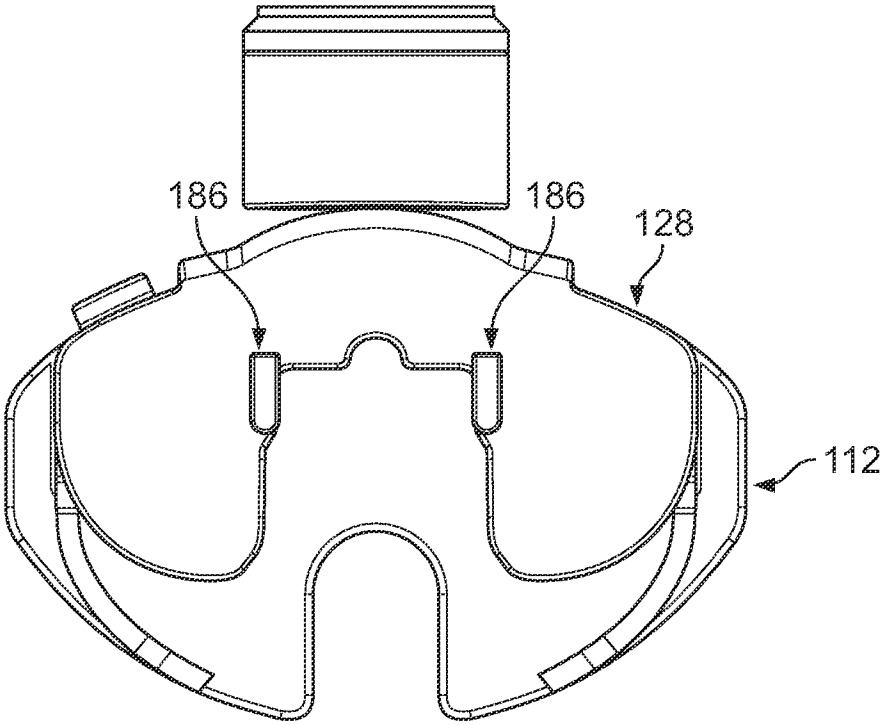
FIG. 31 is a top view of the support bracket of the dispensing system of FIG. 29.
Figure 32:
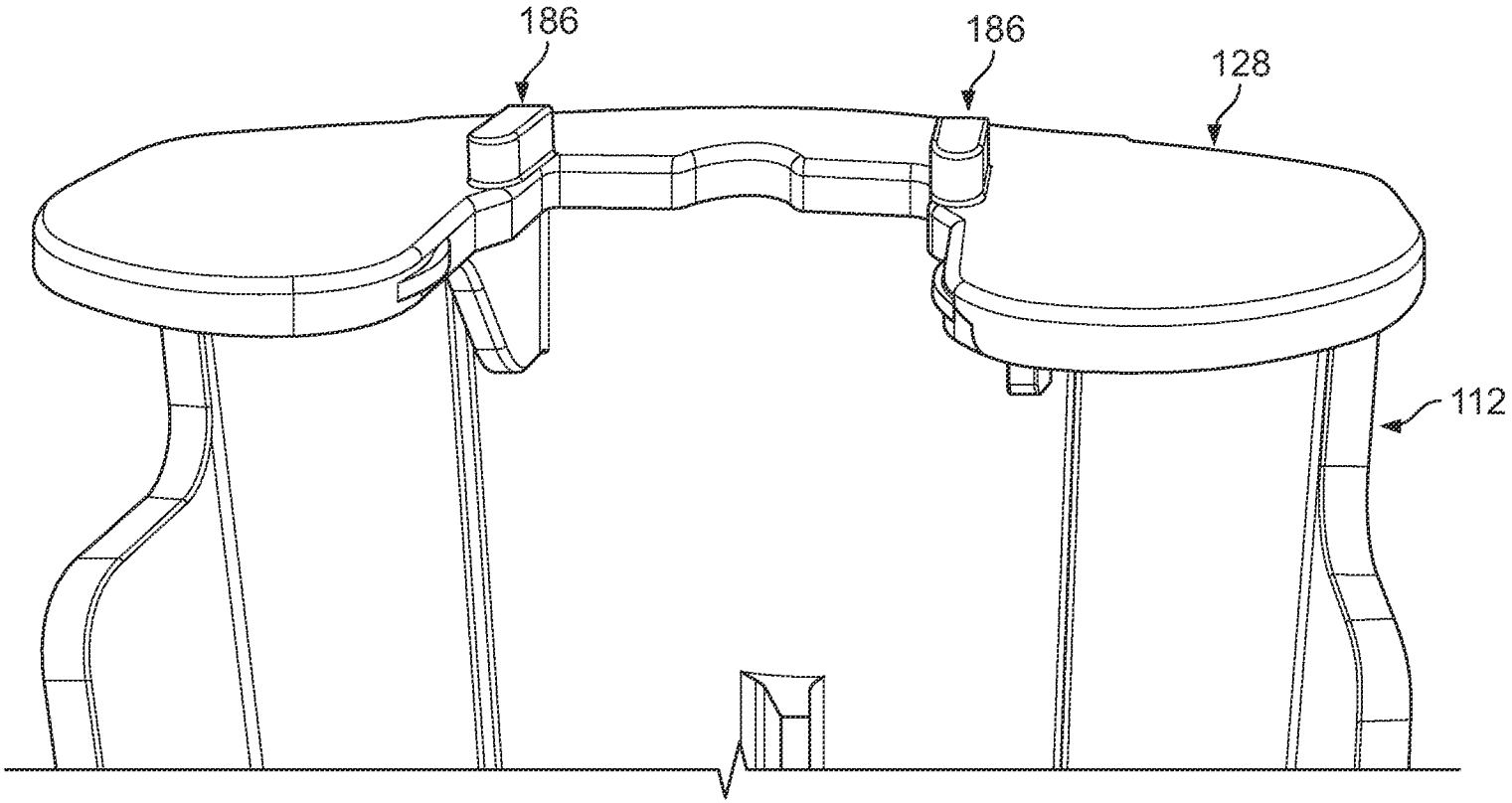
FIG. 32 is a perspective detail view of an upper portion of the support bracket of the dispensing system of FIG. 29.
Figure 33:
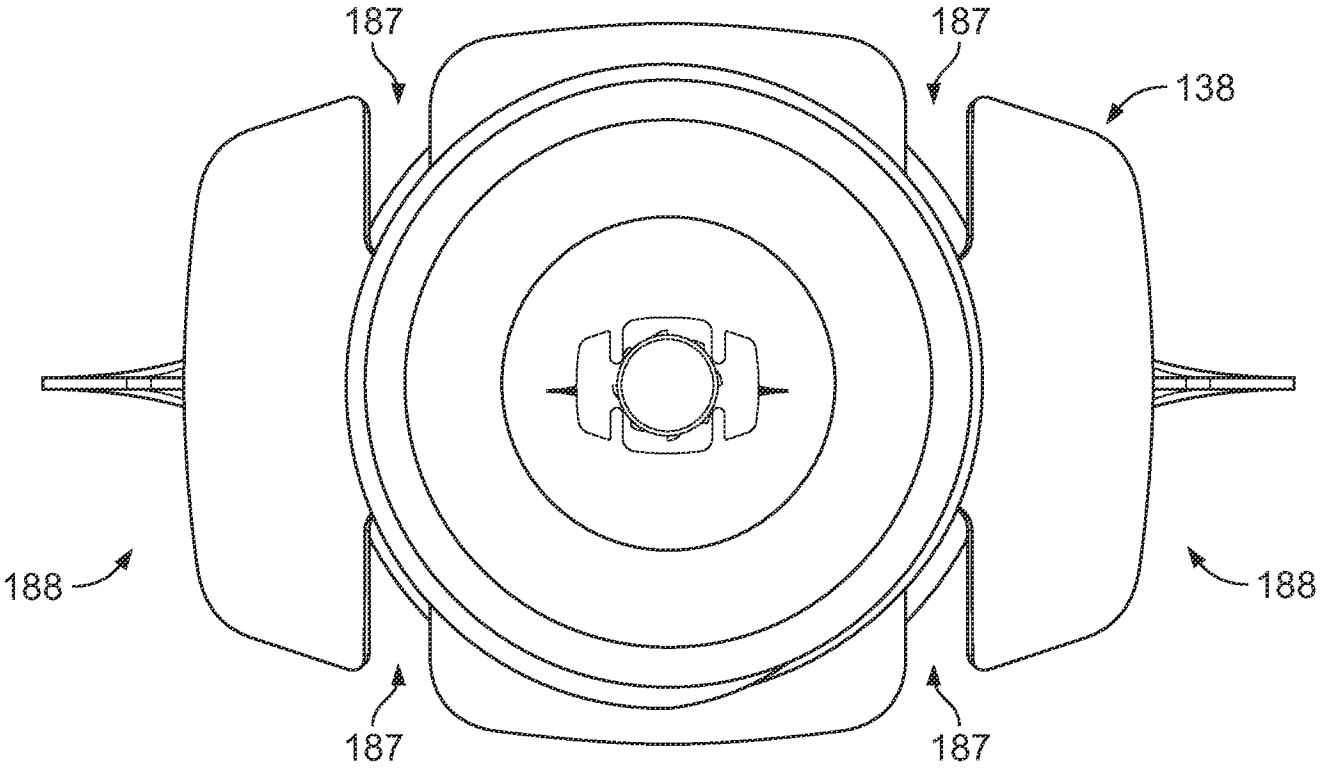
FIG. 33 is a top view of the dispenser assembly of the dispensing system of FIG. 29.
Figure 34:
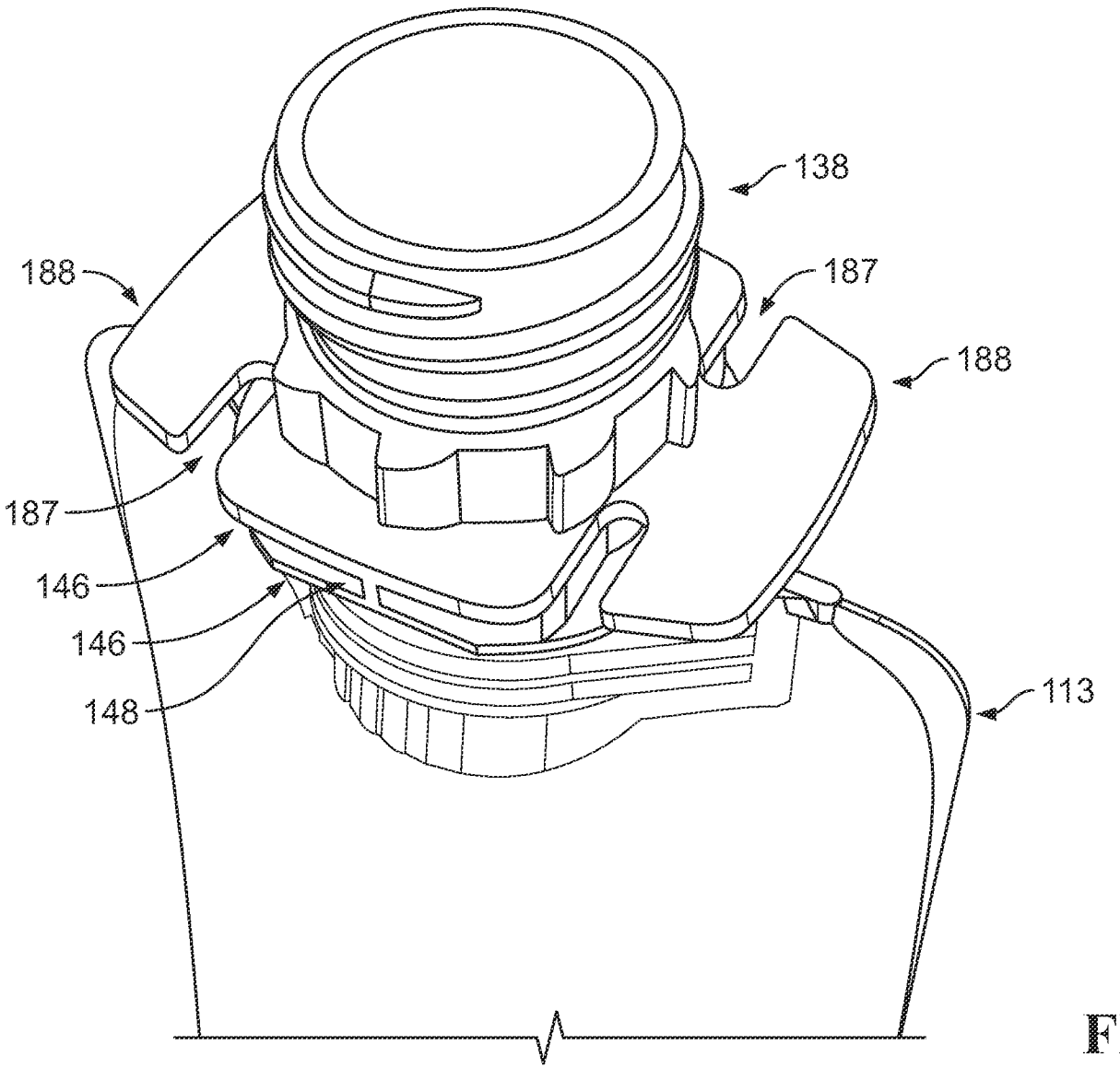
FIG. 34 is a perspective detail view of an upper portion of the dispenser assembly of the dispensing system of FIG. 29.
Figure 35:
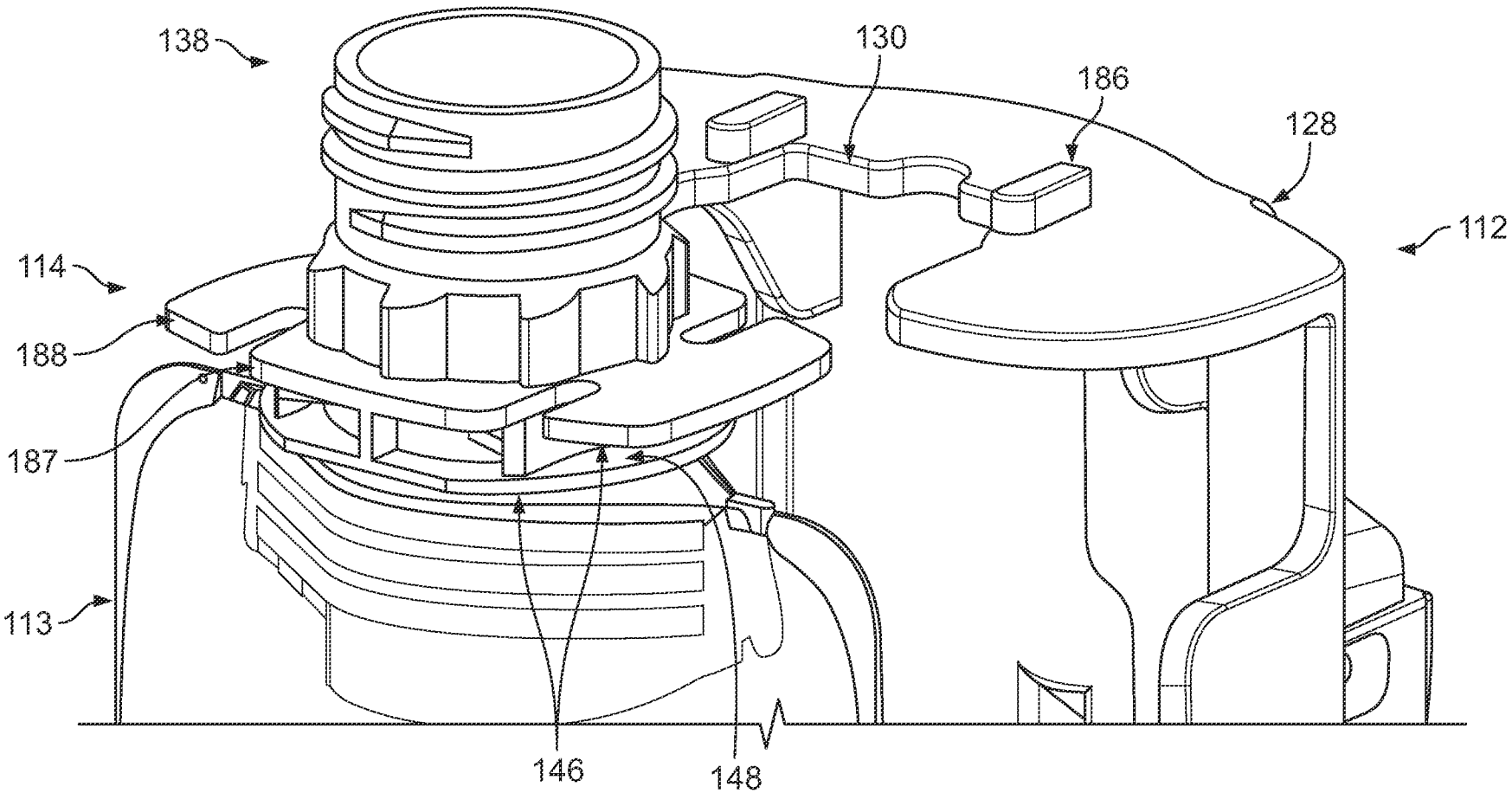
FIG. 35 is a perspective detail view of an upper portion of the dispensing system of FIG. 29, showing the dispenser assembly positioned for mounting to the support bracket.
Figure 36:
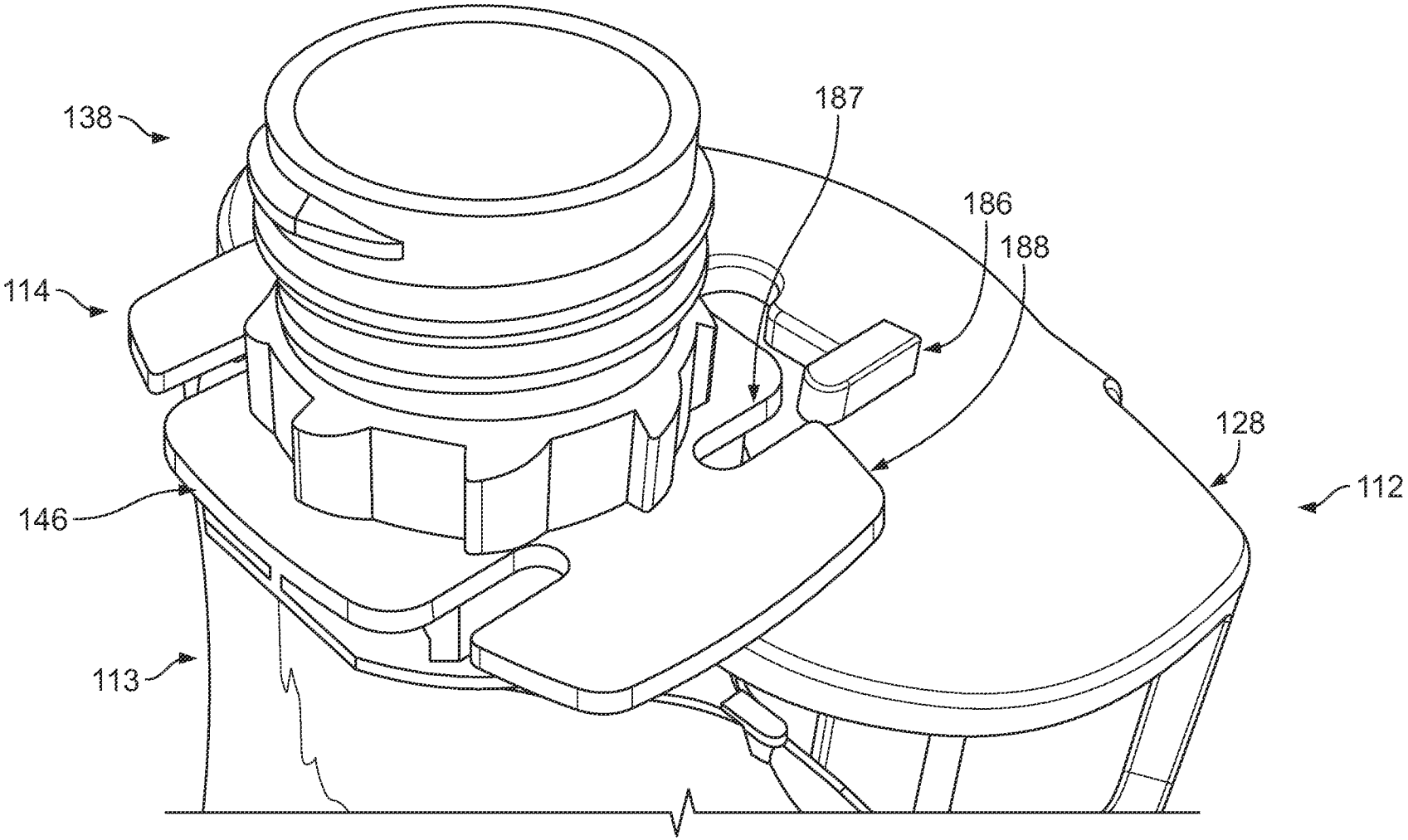
FIG. 36 shows the upper portion of the dispensing system of FIG. 35, with the dispenser assembly being mounted onto the support bracket.
Figure 37:
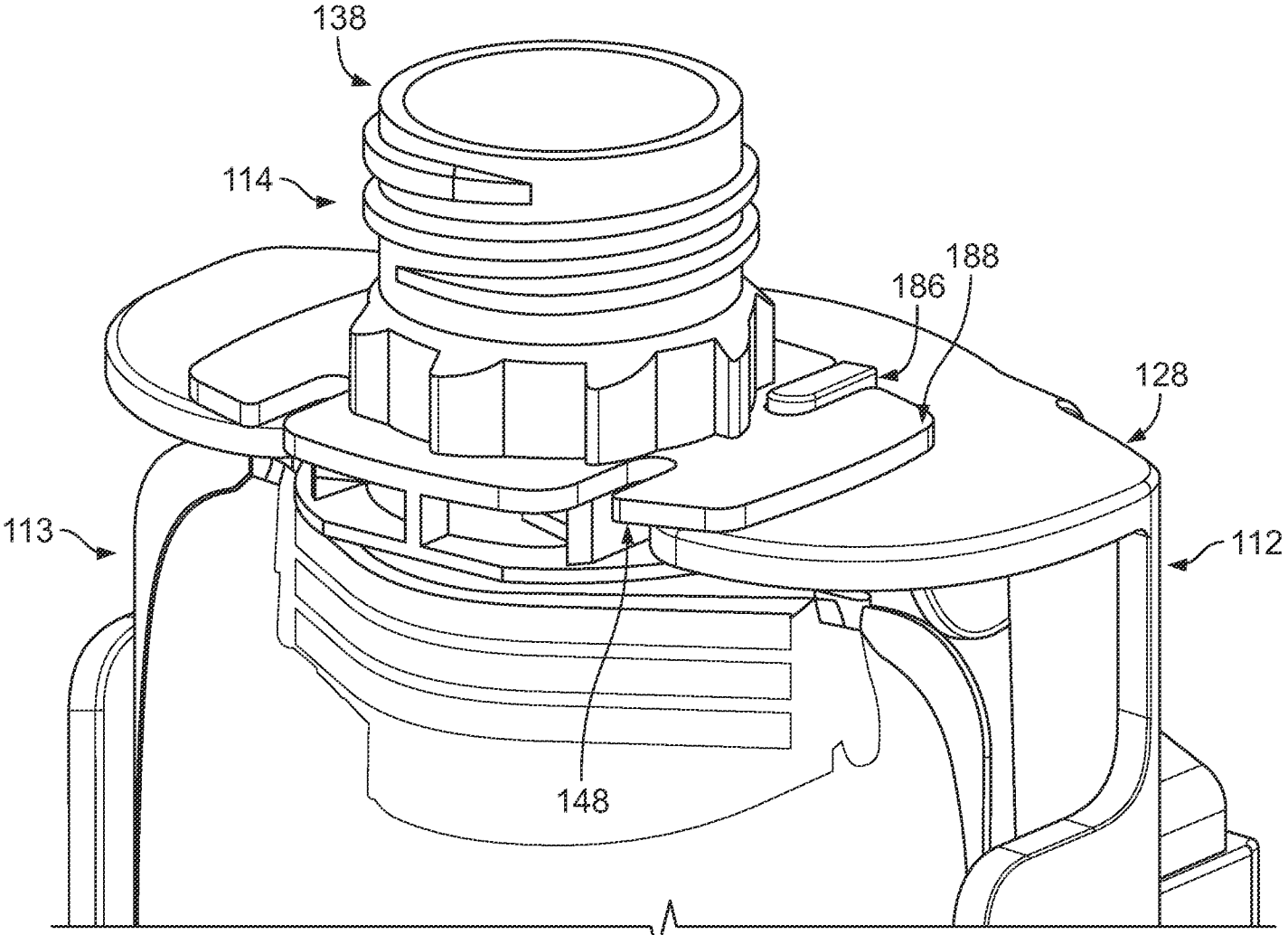
FIG. 37 shows the upper portion of the dispensing system of FIG. 36, with the dispenser assembly fully mounted onto the support bracket.
Figure 38:
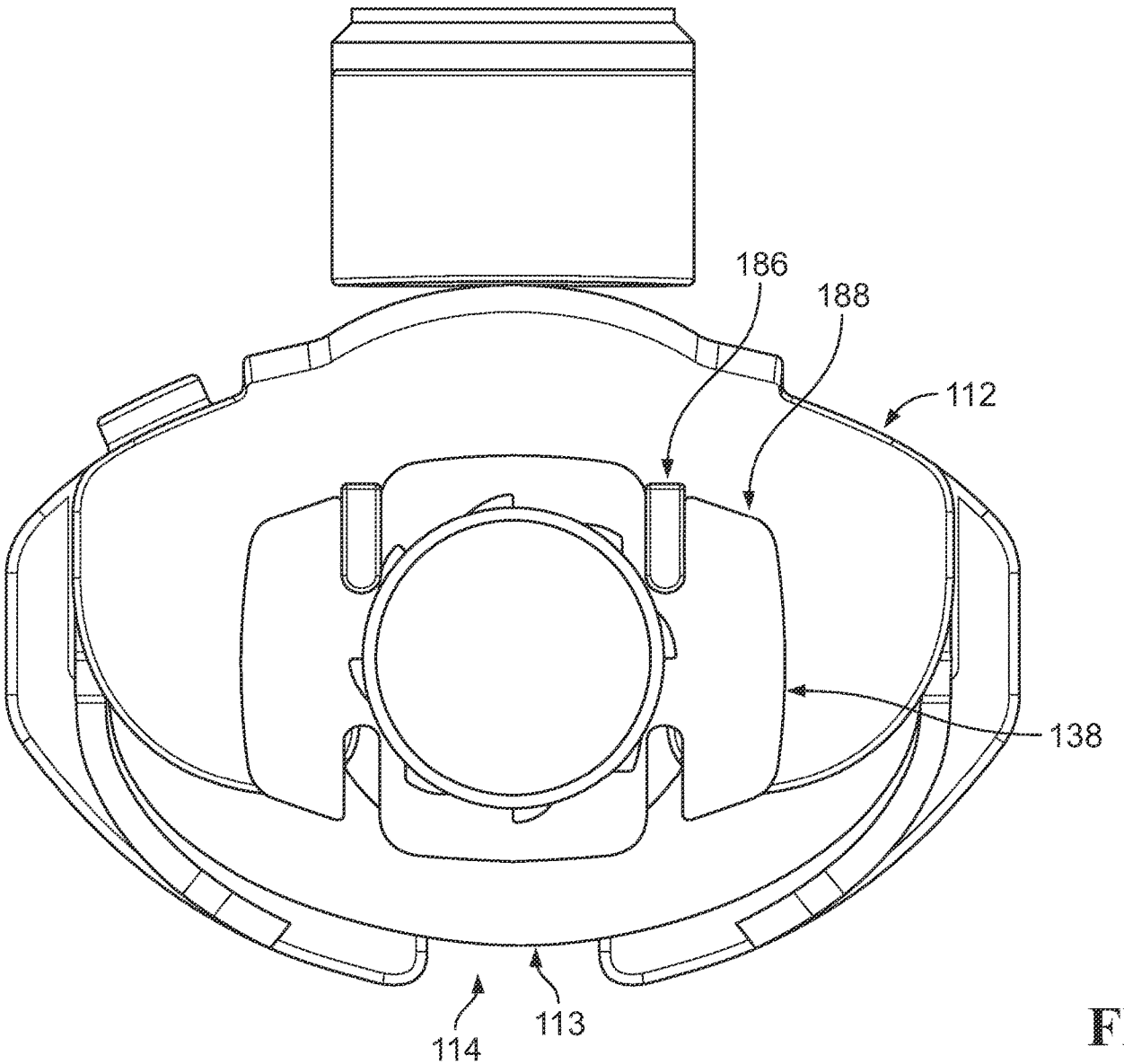
FIG. 38 is a top view of the dispensing system of FIG. 37, with the dispenser assembly fully mounted onto the support bracket.
Figure 39:
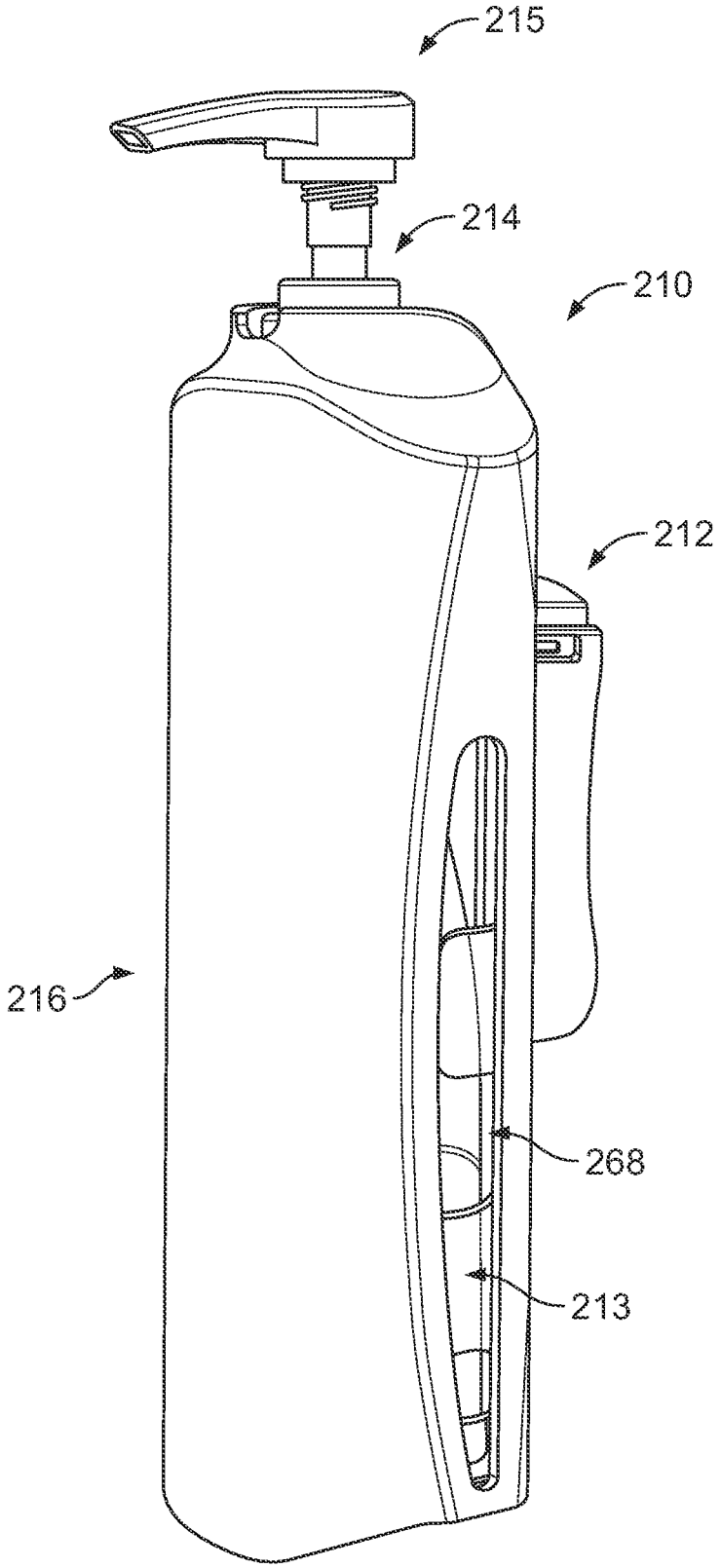
FIG. 39 is a perspective view of a dispensing system according to a third example embodiment, showing a support bracket, a dispenser assembly, and a cover shell in an assembled state.
Figure 40:
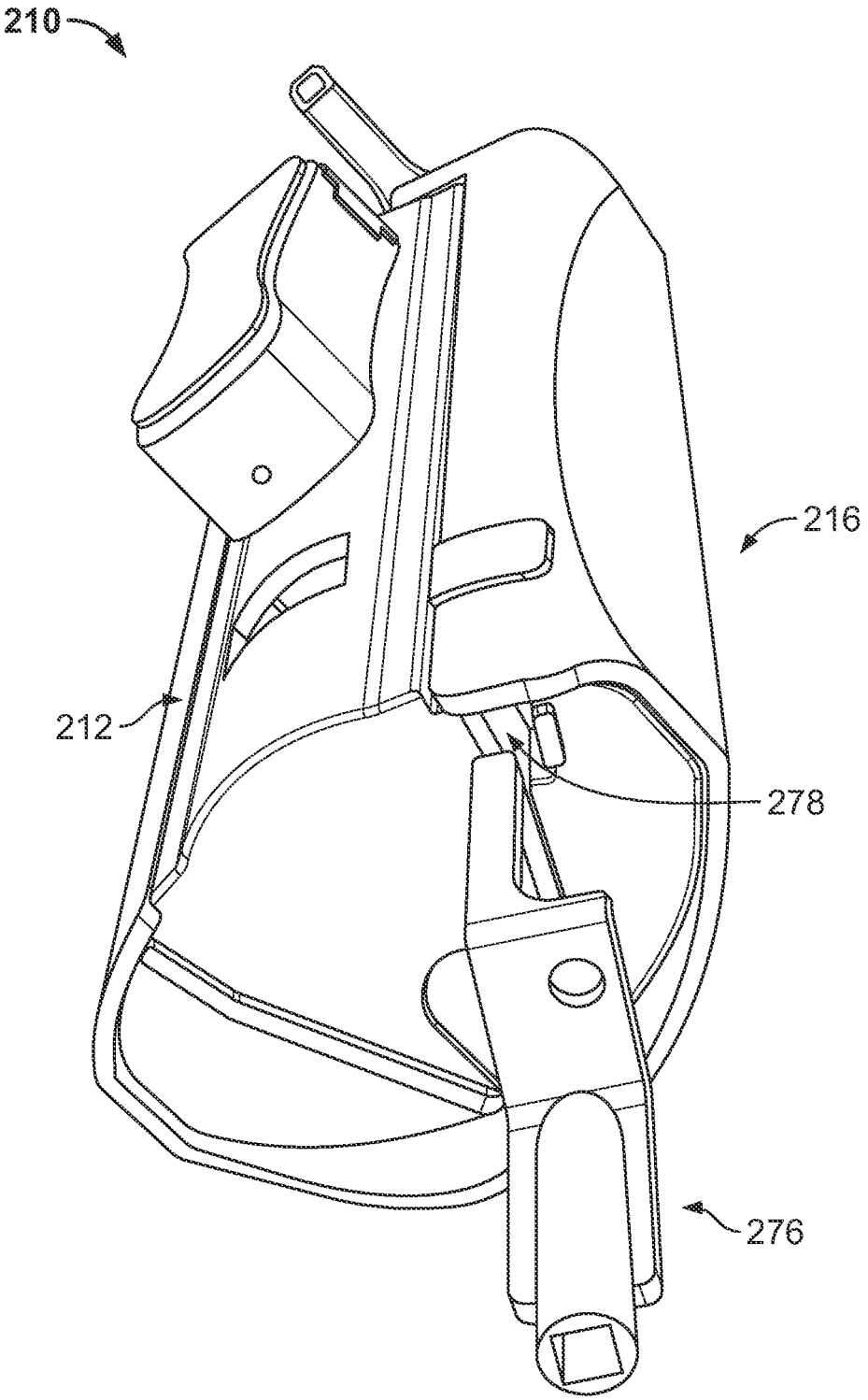
FIG. 40 is a bottom perspective view of the dispensing system of FIG. 39, showing the shell being released from the bracket.
Figure 41:
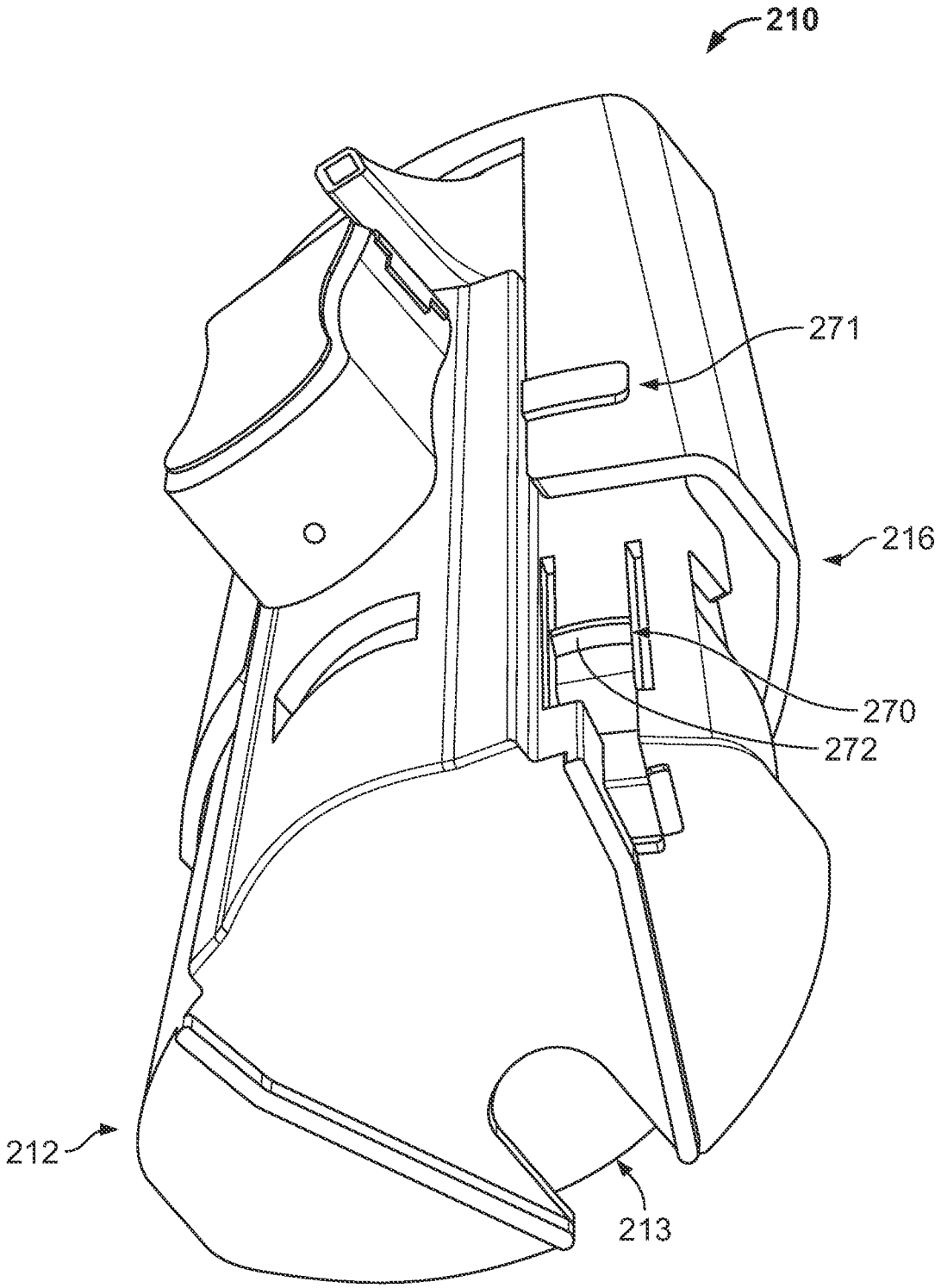
FIG. 41 shows the dispensing system of FIG. 40 with the released shell being removed from the bracket.
Figure 42:
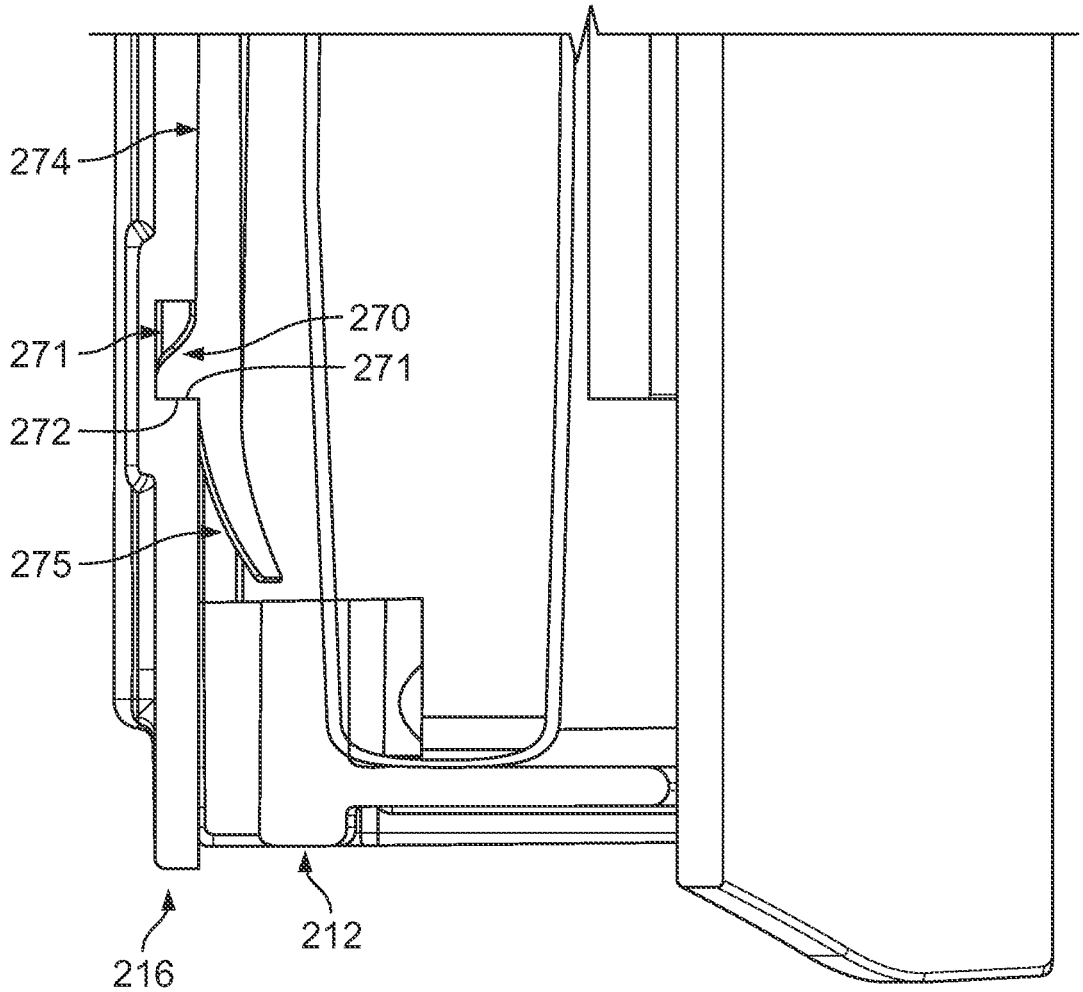
FIG. 42 is a cross-sectional detail view of a portion of the dispensing system of FIG. 39, showing the shell locked to the bracket.

FIGS. 29-30 show details of the recess 130 of the support bracket 112 and the collar 138 of this embodiment. In particular, the recess 130 and the collar 138 are configured to engage each other with a snap-fit connection that enables the collar 138 to be snapped into place and held there securely for use and later snapped out of the bracket engagement for replacement of the container 113, with the snapping in and out done manually by hand without a key or other tool. In the depicted embodiment, for example, the recess 130 in the upper panel 128 of the bracket 112 is formed at least partially by two spaced-apart and inward facing side edges 180 each with a snap-fit recess 181 formed in it. And the collar 130 of the dispenser assembly 114 includes two flanges 146 with a channeled neck/midsection 148 between them, with the dispenser/collar neck 148 having two snap-fit protrusions (e.g., the depicted bulges or bosses) 182 extending laterally outward from its opposite left and right sides. The collar protrusions 182 are received into the bracket recesses 181 with a snap fit (the collar 138 and/or the bracket 112 resiliently deform, e.g., by compression, deflection, or both). To facilitate easy snapping in and out of the collar 138, the bracket recess 130 can be wider at its open front than its closed rear, as depicted.

Also, the dispenser/collar neck 148 can have two orientation protrusions (e.g., the depicted tabs) 183 extending laterally outward from its opposite front and rear sides. And the upper panel 128 of the support bracket 112 includes a rear side edge 184 (that cooperates with the two opposing side edges 180 to form the recess 130) that can have an orientation recess 185 that receives either of the orientation protrusions 183. The orientation protrusions 183 extend laterally outward farther than the snap-fit protrusions 182 to block and thus prevent the collar 138 from being inserted into the recess 130 with the snap-fit features not aligned for engagement.

FIGS. 31-38 show additional details of the dispenser-bracket interface/coupling. Referring particularly to FIGS. 31-34, the upper lateral/transverse panel 128 of the support bracket 128 additionally includes two upwardly extending tabs 186 positioned adjacent the recess 130, and the top flange 146 of the collar 138 additionally includes at least two lateral slots 187 that receive the tabs 186. The slots 187 can be formed by two wings 188 that extend laterally from the respective left and right sides of the top flange 138 of the collar 138. The engagement of the tabs 186 and slots 187 provides a secure fit of the dispenser assembly 114 to the support bracket 112 so that the dispenser assembly 114 does not jostle, rotate, or otherwise move (relative to the bracket 112) during use (e.g., when the dispensing pump is activated by downward applied forces). Also, the wings 188 provide a mechanical-interference block with the bracket tabs 186, unless the dispenser assembly 114 is oriented relative to the support bracket 114 with the tabs 186 and slots 187 aligned, to prevent the dispenser assembly 114 from being installed onto the support bracket 112 unless it is oriented properly. Furthermore, the wings 188 extend laterally outwards above the bracket upper panel 128 to ensure that the dispenser assembly 114 does not move downward relative to the support bracket 112 during use. FIGS. 35-38 show details of these components interfacing as the dispenser assembly 114 is mounted onto the support bracket 112.

FIGS. 39-42 show a dispensing system 210 according to a third example embodiment. The dispensing system 210 of this embodiment can be the same, or substantially the same, as that of the embodiments described above, except with the differences noted herein. As such, the dispensing system 210 includes a support bracket 212, a dispenser assembly 214 (including a container 213 and a delivery mechanism 215) that removably mounts to the support bracket 212, and a cover shell 216 that removably mounts to the support bracket 212 to cover and conceal/obscure the container 213 during Use.

In this embodiment, the viewing window 268 of the shell 216 of this embodiment has a different configuration. In particular, the viewing window 268 of this embodiment is vertically elongated and extends over a substantial portion of the length of the shell 216. This enables visually observing the fluid level in the container 213 over a greater range of levels.

In addition, the shell-to-bracket locking system of this embodiment has a different configuration. The locking system provides the same functionality of releasably locking the shell 216 to the support bracket 212 to prevent unauthorized removal of the shell 216 and accessing of the container 213. And to do this, the locking system includes two contact surfaces, with one on the shell 216 and the other on the support bracket 212, that releasably engage each other to secure the parts together and selectively release them for separation (e.g., by vertical sliding).

In the depicted embodiment, however, the two contact surfaces are reversed, in a vice versa arrangement. In particular, the spring tab structure with the protrusion 270 is a part of the bracket 212, and the aperture 271 that receives the protrusion 270 is a part of the shell 216. The bracket aperture 271 receives the protrusion 270 in a locked position to releasably secure the shell 216 and bracket 212 together, with a contact surface 272 of the protrusion 270 and a contact surface 273 of the aperture 271 engaging each other to provide the releasable locking feature. The protrusion 270 is spring-biased into locking engagement with the aperture 271, for example by being formed on a resiliently deflectable cantilevered arm 274 extending from the bracket 212 (as depicted), or by a coil spring or other spring element.

In addition, the aperture 271 of this embodiment can be a notch, for example as depicted. And the release surface 275 can be located below the protrusion 270, for example adjacent the free end of the cantilevered arm 274, as depicted. The release surface 275 can be ramped (e.g., linearly, curved, or otherwise inclined) so that when the key 276 is moved through the keyhole 278 and into contact with it, the ramped release surface 275 deflects the protrusion 270 to displace and release it from the aperture 271.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in example forms, it will be apparent to those skilled in the art that many modifications, additions, and deletions can be made therein without departing from the spirit and scope of the invention as defined by the following claims.

What is claimed is:

1. A dispensing system for a personal-hygiene fluid, comprising:

a support bracket adapted to mount to a surface and including an upper panel forming a recess;

a replaceable dispenser assembly including a container that holds the fluid and a delivery mechanism attached to the container, wherein the delivery mechanism includes a laterally extending dispensing spout through which the fluid is delivered, wherein the dispenser assembly includes a collar permanently affixed to the container and detachably coupled to the delivery mechanism, wherein the collar is removably receivable in the recess to removably mount the dispenser assembly to the support bracket; and a shell that removably mounts to and cooperates with the support bracket to substantially enclose and obscure the container from view, wherein upon depletion of the fluid in the dispenser assembly, the shell can be removed from the support bracket, the dispenser assembly can be accessed and replenished with a fresh supply of the fluid, and the shell can be reinstalled onto the support bracket, wherein the shell has a top side with a notch through which the dispensing spout is vertically receivable so that the shell is upwardly removable from the support bracket for dispenser assembly replenishing without separating the delivery mechanism from the container, and wherein with the shell removed from the support brackets, the replaceable dispenser assembly, including the container and the delivery mechanism, is removable from the support bracket by being moved laterally relative to the support bracket to laterally displace the collar from the recess so that the dispenser assembly is removable from the support bracket and shell for replenishing without separating the delivery mechanism from the container.

2. The dispensing system of claim 1, wherein the container is suspended from the upper panel of the support bracket.

3. The dispensing system of claim 1, wherein the shell includes slide surfaces and the support bracket includes cooperating slide surfaces that engage with the shell slide surfaces so that the shell vertically slides on and off of the support bracket.

4. The dispensing system of claim 1, wherein the shell and the support bracket include a spring tab structure and an aperture, wherein the spring tab structure includes a protrusion that is spring-biased into a locking position received in the aperture to lock the shell to the support bracket when the shell and the support bracket are in a use position, and wherein the protrusion is displaced from the locking position to a released position clear of the aperture to release the shell from the support bracket when the shell is to be removed from the support bracket.

5. The dispensing system of claim 4, further comprising:

a key that is adapted to displace the protrusion from the aperture to release the shell from the support bracket; and a mounting bracket that mounts to the surface and to which the support bracket releasably locks, wherein the key is adapted to also release the support bracket from the mounting bracket.

6. A method of replenishing the dispensing system of claim 1, comprising:

rotating a dispensing spout of the delivery mechanism from a forward use position to a rearward clearance position;

sliding the shell vertically off of the support bracket with the dispensing spout sliding through an elongated U-shaped notch in the shell;

accessing and replenishing the dispenser assembly;

reinstalling the shell back onto the support bracket; and rotating the dispensing spout back to the forward use position.

7. The dispensing system of claim 1, wherein the notch in the top side of the shell is elongated and U-shaped.

8. The dispensing system of claim 7, wherein the notch in the top side of the shell has a rearward-facing open side in communication with a rear opening of the shell.

9. The dispensing system of claim 7, wherein the dispensing spout rotates between a forward use position and a rearward clearance position, wherein the dispensing spout can be vertically slid through the notch in the top side of the shell when the dispensing spout in the rearward clearance position but not in the forward use position.

10. A dispensing system for a personal-hygiene fluid, comprising:

a support bracket including an upper panel forming a recess, wherein the upper panel includes at least one upwardly extending tab;

a replaceable dispenser assembly including a container that holds the fluid and a delivery mechanism attached to the container, wherein the dispenser assembly includes a collar permanently affixed to the container and detachably coupled to the delivery mechanism, wherein the collar is removably received in the recess to removably mount the dispenser assembly to the support bracket, wherein the collar includes at least one slot that receives the tab when the collar is received in the recess with the dispenser assembly mounted to the support bracket, wherein the at least one slot in the collar is formed by at least one wing extending laterally from the collar, wherein the at least one wing interferes with the at least one tab to block the collar from being mounted into the recess unless the at least one slot and tab are aligned; and a shell that removably mounts to and cooperates with the support bracket to substantially enclose and obscure the container from view, wherein upon depletion of the fluid in the dispenser assembly, the shell can be removed from the support bracket, the dispenser assembly can be accessed and replenished with a fresh supply of the fluid, and the shell can be reinstalled onto the support bracket.

11. The dispensing system of claim 10, wherein the container is a collapsible pouch and the delivery mechanism is a manually operated dispensing pump assembly.

12. The dispensing system of claim 10, wherein the collar includes two spaced-apart flanges and a channeled neck therebetween, wherein the channeled neck is removably received in the recess to removably mount the dispenser assembly to the support bracket, with the flanges positioned above and below the support bracket adjacent the recess to block vertical movement of the container relative to the support bracket, wherein the at least one slot is formed in a top one of the collar flanges and the at least one win extends laterally from the top flange.

13. The dispensing system of claim 10, wherein the recess is formed by edges of the upper panel of the support bracket, wherein the upper panel edges and the collar have snap-fit recesses and protrusions that form a snap-fit connection of the collar in the recess.

14. The dispensing system of claim 10, wherein the recess is formed by edges of the upper panel of the support bracket, wherein the upper panel edges and the collar have an orientation recess and protrusion that block the collar from being inserted into the recess unless the orientation recess and protrusion are aligned.

15. The dispensing system of claim 10, wherein the support bracket is adapted to mount to a surface.

16. A dispensing system for a personal-hygiene fluid, comprising:

a support bracket adapted to mount to a wall surface and including an upper panel forming a recess, wherein the upper panel includes at least one upwardly extending tab;

a replaceable dispenser assembly including a pouch that holds the fluid, a collar permanently affixed to the pouch, and a manually operated dispensing pump assembly detachably coupled to the collar, wherein the collar includes two spaced-apart flanges and a channeled neck therebetween, wherein the channeled neck is removably received in the recess to removably mount the dispenser assembly to the support bracket, with the flanges positioned above and below the support bracket adjacent the recess to block vertical movement of the pouch relative to the support bracket, and with the pouch suspended from the upper panel, wherein a top one of the collar flanges includes at least one slot that receives the tab when the collar is received in the recess with the dispenser assembly mounted to the support bracket, wherein the at least one slot in the top flange is formed by at least one wing extending laterally from the top flange, wherein the at least one wing interferes with the at least one tab to block the collar from being mounted into the recess unless the at least one slot and tab are aligned; and a shell that removably mounts to and cooperates with the support bracket to substantially enclose and obscure the container from view, wherein the shell includes slide surfaces and the support bracket includes cooperating slide surfaces that engage with the shell slide surfaces so that the shell vertically slides on and off of the support bracket;

wherein upon depletion of the fluid in the dispenser assembly, the shell can be removed from the support bracket, the dispenser assembly can be accessed and replenished with a fresh supply of the fluid, and the shell can be reinstalled onto the support bracket.

17. The dispensing system of claim 16, wherein:

the delivery mechanism includes a dispensing spout that rotates between a forward use position and a rearward clearance position; and the shell includes an elongated U-shaped notch through which the dispensing spout can be vertically slid through when in the rearward clearance position but not the forward use position.

18. A replacement dispenser assembly holding a personal-hygiene fluid for use in a dispensing system including a support bracket with an upper panel forming a recess, wherein the upper panel of the support bracket includes at least one upwardly extending tab, the dispenser assembly comprising:

a container that holds the fluid;

a manually operated dispensing pump assembly; and a collar permanently affixed to the container and detachably coupled to the manually operated dispensing pump assembly, wherein the collar includes two spaced-apart flanges and a channeled neck therebetween, wherein the channeled neck is removably received in the recess to removably mount the dispenser assembly to the support bracket, with the flanges positioned above and below the support bracket adjacent the recess to block vertical movement of the container relative to the support bracket, wherein the collar includes at least one slot that receives the tab when the collar is received in the recess with the dispenser assembly mounted to the support bracket, wherein the at least one slot is formed by at least one wing extending laterally from the collar, wherein the at least one wing interferes with the at least one tab to block the collar from being mounted into the recess unless the at least one slot and tab are aligned, wherein upon depletion of the fluid in the dispenser assembly, the dispenser assembly can be accessed and replenished with a fresh supply of the fluid.

19. The replacement dispenser assembly of claim 18, wherein the collar includes two spaced-apart flanges and a channeled neck therebetween, wherein the channeled neck is removably received in the recess to removably mount the dispenser assembly to the support bracket, with the flanges positioned above and below the support bracket adjacent the recess to block vertical movement of the container relative to the support bracket, wherein the at least one slot is formed in a top one of the collar flanges and the at least one wing extends laterally from the top flange.

20. The replacement dispenser assembly of claim 18, wherein the container is a collapsible pouch and the delivery mechanism is a manually operated dispensing pump assembly.

* * * * *